US011299922B2

(12) United States Patent
Oakley et al.

(10) Patent No.: US 11,299,922 B2
(45) Date of Patent: Apr. 12, 2022

(54) MODULAR DOOR OPERATING LINKAGE SYSTEM AND RELATED METHOD FOR CONNECTING A DOOR TO A DRIVER

(71) Applicant: MOTIONACCESS, LLC, Elk Grove Village, IL (US)

(72) Inventors: Robert L. Oakley, Chicago, IL (US); Joseph P. Madden, Des Plaines, IL (US)

(73) Assignee: MOTIONACCESS, LLC., Elk Grove Village, IL (US)

( * ) Notice: Subject to any disclaimer, the term of this patent is extended or adjusted under 35 U.S.C. 154(b) by 40 days.

(21) Appl. No.: 16/857,346

(22) Filed: Apr. 24, 2020

(65) Prior Publication Data

US 2020/0340280 A1 Oct. 29, 2020

Related U.S. Application Data

(60) Provisional application No. 62/838,907, filed on Apr. 25, 2019.

(51) Int. Cl.

| | |
|---|---|
| ***E05F 3/00*** | (2006.01) |
| ***E05F 3/22*** | (2006.01) |
| *E05F 15/63* | (2015.01) |

(52) U.S. Cl.

CPC ..... *E05F 3/227* (2013.01); *E05F 15/63* (2015.01); *E05F 2003/228* (2013.01); *E05F 2015/631* (2015.01); *E05Y 2900/132* (2013.01)

(58) Field of Classification Search

CPC ..... E05C 17/02; E05C 17/54; E05C 17/34; E05C 17/32; E05F 3/22; E05F 3/221;

(Continued)

(56) References Cited

U.S. PATENT DOCUMENTS 2,012,731 A * 8/1935 Sasgen ..... E05C 17/34 292/263
2,960,718 A * 11/1960 Lasier ..... E05F 3/22 16/49

(Continued)

FOREIGN PATENT DOCUMENTS

GB 1435081 A * 5/1976 ..... E05F 3/221
JP 07269219 A * 10/1995

(Continued)

*Primary Examiner* — Chuck Y Mah
(74) *Attorney, Agent, or Firm* — Law Office of John W. Harbst

(57) ABSTRACT

A modular door operating linkage system connectable to an extendable from a door pivotable between closed and open positions about a generally vertical axis disposed such that the door can be either pushed or pulled between positions. The modular linkage system includes a rigid generally L-shaped crank arm component connected to a powered driver which drives the crank arm component in opposite arcuate directions. The modular linkage system also includes a rigid elongated track component defining a generally C-shaped linear channel. The modular linkage system also includes a rigid but adjustable multipiece link component. The linkage system further includes a rigid block component which is configured and designed to act in concert with the other components of the linkage system. The various components of the linkage system are designed and configured relative to each other such that they can be selectively interchanged with and connected to each other and to the door in a multitude of different arrangements and scenarios to easily and readily accommodate different environments wherein the door is utilized. A method for connecting a door to a powered driver is also disclosed.

16 Claims, 19 Drawing Sheets

(58) Field of Classification Search
CPC ..... E05F 3/227; E05F 1/08; E05F 2003/228; E05F 2015/631; E05F 15/63; E05Y 2900/132; Y10T 16/469; Y10T 16/459; Y10T 16/462; Y10T 16/27; Y10T 16/286; Y10T 16/299; Y10T 16/56; Y10T 16/577; Y10T 16/585; Y10T 16/61
See application file for complete search history.

(56) References Cited

U.S. PATENT DOCUMENTS 3,259,936 A * 7/1966 Sheridan ..... E05C 17/32 16/49
3,683,450 A * 8/1972 Morrison ..... E05C 17/28 16/49
3,909,876 A * 10/1975 Zunkel ..... E05F 3/00 16/71
4,069,546 A * 1/1978 Reichlin ..... E05F 3/22 16/85
4,102,005 A * 7/1978 Schnarr ..... E05F 3/221 16/49
4,160,304 A * 7/1979 Smith ..... E05F 3/221 16/49
4,419,786 A * 12/1983 Surko, Jr. ..... E05F 3/22 16/51
4,837,890 A * 6/1989 Tully ..... E05C 17/28 16/71
4,967,512 A * 11/1990 Schroder ..... E05F 5/12 49/367
5,381,628 A * 1/1995 D'Hooge ..... E05C 17/28 16/49
5,448,798 A * 9/1995 Coleman ..... E05C 17/28 16/85
5,551,740 A * 9/1996 Lin ..... E05F 3/221 292/262
6,009,597 A * 1/2000 Yu ..... E05F 5/02 16/85
8,720,113 B1 * 5/2014 Krivoy ..... E05F 15/63 49/341
2006/0244271 A1 * 11/2006 Hass ..... E05F 15/63 292/336.3
2014/0143979 A1 * 5/2014 Winkler ..... E05F 3/22 16/71
2014/0165329 A1 * 6/2014 Wildforster ..... E05F 3/227 16/71

FOREIGN PATENT DOCUMENTS

JP 2006052534 A * 2/2006
JP 2007138458 A * 6/2007
KR 100888724 B1 * 3/2009

* cited by examiner

MODULAR DOOR OPERATING LINKAGE SYSTEM AND RELATED METHOD FOR CONNECTING A DOOR TO A DRIVER

RELATED APPLICATION

This patent application is related to co-assigned and co-pending U.S. PROVISIONAL patent application Ser. No. 62/838,907, filed Apr. 25, 2019; the entirety of which is incorporated herein by reference.

FIELD OF THE INVENTION DISCLOSURE

This invention disclosure generally relates a left-handed push/pull door or a right-handed push/pull door movable between open and closed positions about a generally vertical pivot axis and, more particularly, to a modular door operating linkage system and related method for connecting either type door to a powered driver.

BACKGROUND

Doors which swing about a vertical pivot axis as they move between open and closed positions are commonly used as entryway doors in any of a variety of different locations. Such doors have an interior side and exterior side. In some situations, a door is known to pivotally move from a closed position toward an open position about an axis disposed toward a left side of the door. Moreover, the door can either be "pushed/pulled" open and/or "pushed/pulled" closed. Accordingly, such a door when connected to a powered driver is commonly referred to as a "left-handed push door" or a "left-handed pull door". Alternatively, a door is known to pivotally move from a closed position toward an open position about an axis disposed toward a right side of the door. Accordingly, such a door when connected to a powered drive is commonly referred to as a "right-handed push door" or a "right-handed pull door".

Typically, a "left-handed push door" or a "right handed push door" swing open to an exterior of the room or other enclosure while a "left-handed pull door" and a "right-handed pull door" open to an interior of the room or other enclosure. Suffice it to say, the doors are operable in any of a multitude of applications.

To ease accessability into a store, room or other enclosure, such doors are operated between closed and open positions by the powered driver having a positively driven output shaft. The output shaft of the driver is operably connected to the door through a linkage system. That is, the output shaft of the driver can be positively driven in either of two rotational directions; with one direction being the opposite of the other. As will be appreciated by those skilled in the art, the situation of the doors being pivotally movable in either a left-handed direction or right-handed direction can complicate which powered driver is to be selected for which application. Moreover, the ability of the doors to swing or pivotally swing open to an interior of the room or other enclosure while other doors swing open to an exterior of the room or other enclosure can and often does furthermore complicate repair and/or replacement of which powered driver and which linkage system is to be applied to which door.

The linkage system used to connect the output shaft of the driver to the door can take any of a variety of different designs depending upon a number of different considerations. That is, the components of the linkage system used to connect the output shaft of the driver to a "left-handed push door" can be and often are different from the linkage system used to connect the output shaft of the driver to a "right-handed push door". Similarly, the components of the linkage system used to connect the output shaft of the driver to a "left-handed push door" can be and typically are different from the linkage system used to connect the output shaft of the driver to a "right-handed push door". Moreover, and as is understandable, the components of the linkage system used to connect the output shaft of the driver to a "left-handed pull door" which swings or pivotally opens to an interior of the room or other enclosure are usually different from the components of the linkage system used to connect the output shaft of the driver to a "right handed pull door" which swings or pivotally opens to an exterior of the room or other enclosure. As such, and to repair or replace a broken or faulty door arrangement requires a repair person to take time to inquire about the specifics of the particular door arrangement while also requiring a large inventory of a wide variety of different drivers and linkage systems to accommodate the variety of different door operating systems.

In many applications, the output shaft of the driver for the linkage system used to operably connect the positively driven output shaft of the powered driver to the door includes a drive link extending in a generally orthogonal direction away from the output shaft of the driver. Also, it is beneficial for the linkage system, used to operably connect the door to the output shat of the powered driver, to be adjustable such that the open position for the door can be adjusted. The ability to adjust the open position of the door can be a particularly important concern. It is a particularly important concern when the open position of the door is adjacent to a wall of the facility, building, room, etc. and there is no room for the linkage system to operate and function as intended. Of course, in many situations, it is desired to maximize the door opening by having the door swing to a fully open position and, yet, not contact the adjacent wall. As such, and besides being adaptable to many different situations and applications, the linkage system used to connect the door to the output shaft of the driver also needs to be adjustable to accommodate those variety of circumstances to which the particular invention finds utility.

Thus, there is continuing need and desire for a modular door operating linkage system and related method for connecting a door to a driver which is simple, cost effective, efficient and yet adapted to any of a variety of different door operating conditions and situations.

SUMMARY

According to one aspect of this invention disclosure, there is provided a modular door operating linkage system connectable to an extendable from a door which moves between closed and open positions about a generally vertical axis. The door has both interior and exterior sides and, in one form, the modular door operating linkage system includes a rigid generally L-shaped crank arm component having a first end and a free-ended second end. In one arrangement of the linkage system, the first end of the crank arm component is connected to a powered driver which can positively drive the crank arm component in opposite arcuate directions. The modular linkage system also includes a rigid elongated track component which, in one arrangement of the linkage system, is configured for securement or attachment to one side of the door. In alternative embodiment or arrangement of the linkage system, the elongated track component is designed and configured to be otherwise disposed in operable combination with other components of the linkage system. Preferably, the elongated track component defines an open-sided generally C-shaped channel which opens at opposite ends thereof.

The modular door operating linkage system also includes a rigid multipiece link component having opposed ends. To enhance its versatility, an overall length of the link component is adjustable between opposed ends thereof. A suitable fastener is arranged in operable combination with the pieces of the link component to adjustably fix the overall length of the link component as desired or required. The multipiece link component is configured so as to allow opposed ends of the multipiece link component to be articulately connected to other components of the modular door operating linkage system in different configurations thereof.

The modular door operating linkage system further includes a rigid block component that is sized to snugly fit and slidably move within the generally C-shaped channel defined by the elongated track component in one configuration of the modular door operating linkage system. Alternatively, the block component is configured so as to permit the block component in other configurations of the modular linkage system, to be articulately connected to other components of the modular door linkage system. The block component is furthermore configured so as to permit the block component, in still another alternative configuration of the linkage system, to be secured or otherwise fastened to either side of the door. Suffice it to say, the components of the modular linkage system are configured and designed relative to each other such that various components of the modular linkage system can be selectively arranged and connected to each other and to the door in different arrangements and scenarios to easily and readily accommodate different environments wherein the door is utilized.

In a preferred form, the elongated track component has a bottom wall and two laterally spaced side walls extending from the bottom wall. Preferably, each side wall of the track component has a top wall section extending generally coplanar relative to each other and toward a longitudinal center of the track component so as to provide the track component with the generally C-shaped linear open-sided channel extending the length of the track component. In one form, and to enhance the versatility of and allow the track component to be readily used in multiple variations of the linkage system, each side wall of the elongated track component preferably defines laterally aligned openings toward opposite ends thereof whereby facilitating securement of the elongated track component to one side of the door in one configuration or arrangement of the linkage system. The bottom wall of the elongated track component defines at least one opening toward opposite ends thereof whereby allowing the opposed ends to be connected to other components of the modular door operating linkage system in alternative configurations of the linkage system.

In a preferred embodiment, the block component of the linkage system defines a vertical bore opening at opposite ends to generally parallel upper and lower surfaces of the block component as to allow the block component, in one configuration of the linkage system, to be articulately connected to other components of the linkage system. Preferably, the block component further defines spaced throughbores opening to front and rear sides of the block component so as to permit the block component, in yet another alternative configuration of the linkage system, to be secured or mounted, as by fasteners or the like, to either the interior or the exterior side of the door. Moreover, and in one embodiment, the block component is comprised of first and second pieces arranged in back-to-back relation relative to each other.

Preferably, and in an effort to simplify and reduce the overall cost of the linkage system, in one form, the fasteners extending through and used to secure or fasten the elongated track component to either side of the door, in one configuration of the modular linkage system, are the same fasteners used to secure or mount the block component to either side of the door in another alternative configuration of the modular linkage system.

In one embodiment, the block component further includes a mechanism for biasing the block component in one direction toward one of the side walls on the track component and within the generally C-shaped channel defined by the track component when the block component is so disposed. Furthermore, and to further enhance the versatility of the modular linkage system, the crank arm can be oriented in different dispositions relative to the other components connected thereto to allow the linkage system to be used in operable combination with a door which moves in opposite directions between closed and open positions.

According to another aspect of this invention disclosure, there is provided a method for connecting a door which moves between closed and open positions about a generally vertical axis to a powered driver having a driven output shaft. The door has both interior and exterior sides. The method preferably includes the steps of: using a modular linkage system to connect either a left hand or right hand operating door to the driven output shat of the powered driver. To enhance its versatility, the modular linkage system is operable from either the interior side or exterior side of the door. The modular linkage system includes a rigid generally L-shaped crank arm component having a first end and a free-ended second end. The first end of the crank arm is connectable to the output shaft of the powered driver and extends away from either the interior side or exterior side of the door depending on the final configuration of the linage system. The crank arm component is positively driven in opposite arcuate directions depending upon the driven direction of the output shaft of the powered driver.

According to this aspect of the invention disclosure, another step in the process includes: providing the modular linage system with a rigid elongated track component defining a generally C-shaped linear and open-sided channel extending the length of the track component. In one embodiment or arrangement of the linkage system, the elongated track component is designed and configured to allow it to be fastened or otherwise secured to either side of the door. In alternative arrangement of the linkage system, the elongated track component is configured to permit it to be articulately connected between other components of the linkage system.

Preferably, the elongated track component has a bottom wall and two laterally spaced side walls extending upward from the bottom wall. In one form, each side wall of the track component has a top wall section extending generally coplanar relative to each other and toward a longitudinal center of the track component whereby providing the C-shaped channel of the track component with a predetermined width and predetermined height. In one embodiment, each side wall of the elongated track component defines aligned openings toward opposite ends thereof for permitting fasteners to extend therethrough so as to secure the track component to the door in one configuration of the linkage system. The bottom wall of the elongated track component defines at least one opening toward opposite ends thereof whereby allowing the opposed ends of the track component to be connected to other components of the modular linkage system in an alternative configuration of the linkage system.

According to this aspect of the invention disclosure, another step in the process includes providing the modular linage system with a rigid multipiece link component having opposed ends. According to this aspect of the invention disclosure, another step in the process involves designing the multipiece link component such that an overall length of the link component is adjustable between the opposed ends thereof. A suitable fastener is arranged in operable combination with the pieces of the link component to adjustably fix the overall length of the link component as desired or required. The multipiece link component defines openings toward the opposed ends whereby allowing the opposed ends of said multipiece link component to be articulately connected to other components of the modular linkage system.

According to this aspect of the invention disclosure, another step in the process includes providing the modular linage system with a rigid block component. The rigid block component preferably has upper and lower surfaces along with front and rear sides. In one configuration or arrangement of the modular linkage system, the block component is sized to snugly fit and slidably move within the generally C-shaped channel defined by the elongated track component. The block component preferably defines a bore opening to the upper and lower surfaces thereof whereby permitting the block component to be articulately connected to other components of the modular linkage system. The block component also defines spaced bores which open to the front and rear sides of the block component to permit the block component, in still another configuration of the linkage system, to be secured by fasteners to either side of the door. Preferably, the block component of the modular linkage system is formed from at least two pieces.

According to this aspect of the invention disclosure, another step in the method for connecting a door, movable between closed and open positions about a generally vertical axis, to a powered driver having a driven output shaft involves: selecting which configuration of the various components of the modular linkage system are best suited to accommodate operation of a door which can be required to operate from a closed position in reverse directions and whether the modular linkage system is arranged to the interior side or exterior side of the door.

Preferably, the step of selecting which configuration of the modular linkage system is best suited to accommodate operation of a door further involves the step of: selecting the overall length of the link component along with which components are to be operably connected to each other and in what order and in which orientation. To achieve these and other results, the components of the modular linkage system are designed and configured to allow them to be used in multiple configurations and orientations relative to each other.

In a preferred form of this invention disclosure, and to further simplify the methodology used to connect the powered driver to the door, the fasteners used to secure the track component to the door, in one configuration of the modular linkage system, are the same as the elongated fasteners used to secure the block component to the door in another configuration of the modular linage system.

In many of the alternative configurations of the linkage system, a spring mechanism is provided for biasing the block component in one direction within the generally C-shaped channel of the elongated track. Such design permits the method for connecting the door to the powered driver to preferably include the step of: biasing the block component of modular linkage system toward one of the side walls and within the channel of the rigid elongated track component in one configuration of said modular linkage system.

DETAILED DESCRIPTION

Figure 1:
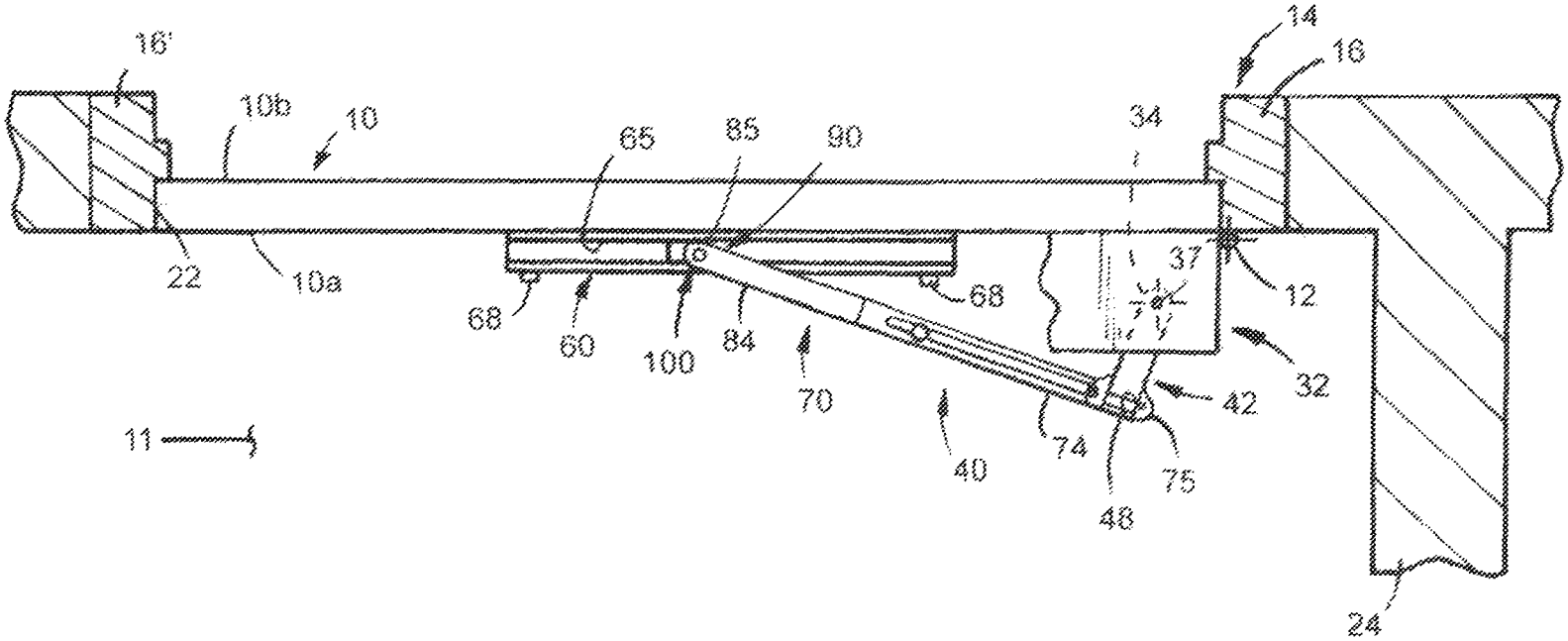
FIG. 1 is a top plan view, partly in section, of one arrangement of a modular linkage system connected to a closed right-handed pull door wherein a pivot axis for the door and the connected driver are arranged toward an interior side of the door.

While this invention disclosure is susceptible of embodiment in multiple forms, there is shown in the drawings and will hereinafter be described preferred embodiments, with the understanding the present disclosure is to be considered as setting forth exemplifications of the disclosure which are not intended to limit the disclosure to the specific embodiments illustrated and described.

Referring now to the drawings, wherein like reference numerals indicate like parts throughout the several views, FIG. 1 schematically illustrates one example of a door arrangement wherein a door operating system, which is the subject of this invention disclosure, finds utility. In the embodiment illustrated by way of example in FIG. 1, there is provided a door 10 which can move between open and closed positions to allow ingress and egress from a building, a walled room or other suitable space, generally indicated by reference numeral 11. As illustrated in FIG. 1, door 10 has a generally flat interior surface 10*a* and a generally flat exterior surface 10*b*.

Figure 2:
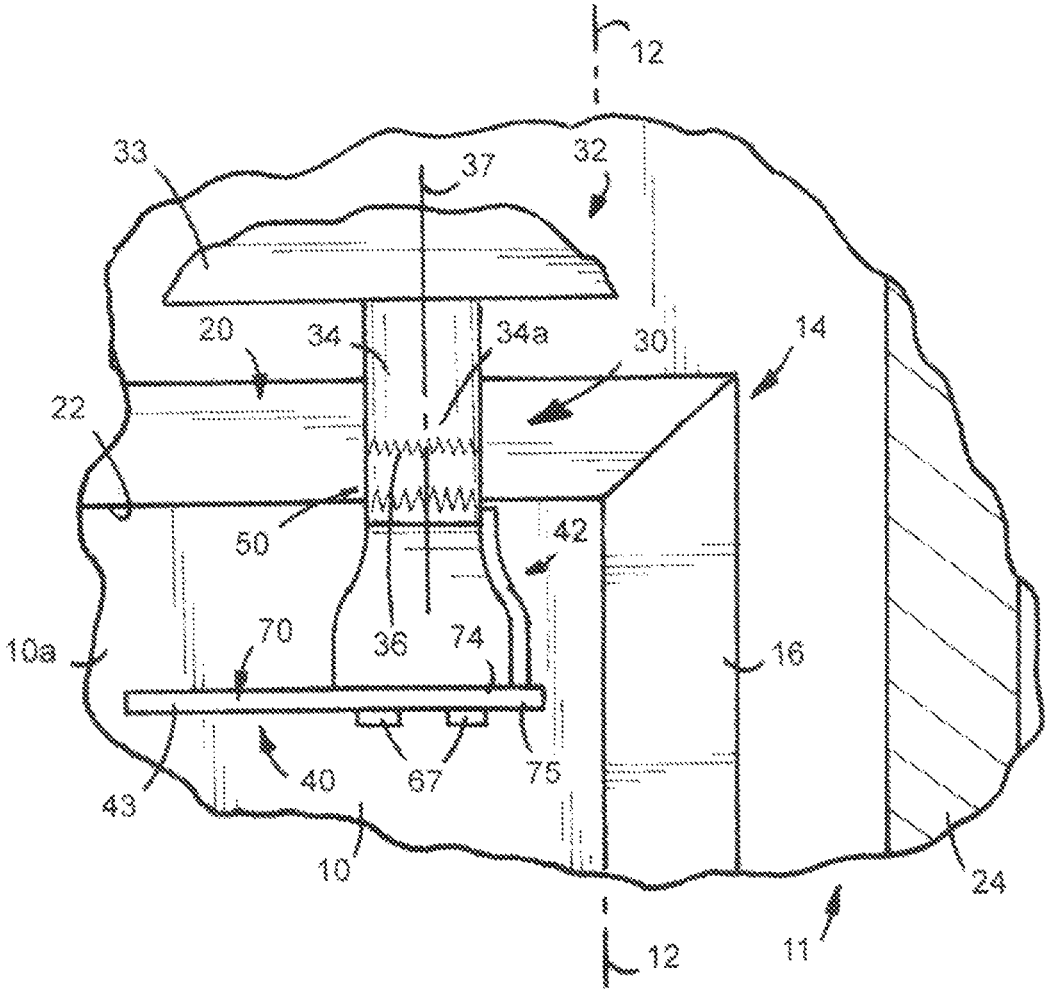
FIG. 2 is an enlarged elevational view showing one arrangement of the modular linkage system illustrated in FIG. 1.

In one form, door 10 is schematically illustrated for pivotal movements about a generally vertical and stationary axis 12. The door 10 moves with respect to a door frame 14 having upstanding side frame members 16, 16' which are rigidly joined to each other by a header or top frame member 20 (FIG. 2). The frame members combine to define an opening 22 allowing access to and from building, room, etc. 11. In the illustrated embodiment in FIGS. 1 and 2, the building, walled room or other space 1 can often include a wall 24 extending generally perpendicular relative to a major plane of door 10 when door 10 is closed. In the embodiment illustrated by way of example in FIG. 1, door 10 swings or pivots toward the side wall 24 as it moves from a closed and toward an open position.

In the embodiment illustrated by way of example in FIG. 2, the door 10 swing or pivots about axis 12 disposed toward a right side or edge of the door 10. As such, in the embodiment illustrated by way of example in FIGS. 1 and 2, door 10 is commonly referred to as a "right-handed door". Moreover, in the embodiment illustrated by way of example in FIG. 1, the door 10 swings or pivots about axis 12 and toward an interior of room.

A door operating system 30 is provided in operable combination with door 10 so as to repeatedly and consistently move the door 10 about axis 12 between closed and open positions. In the arrangement illustrated by way of example in FIG. 2, the door operating system 30 includes a conventional powered driver 32. In the illustrated embodiment, driver 32 is suitably mounted and secured adjacent one of the upstanding door frame members 16 above the door 10 and typically proximate the axis 12 about which the door 10 pivots. As discussed below, the driver 32 can be suitably arranged such that it is arranged and disposed either toward an interior or exterior side of the door 10. As illustrated by way of example in FIG. 2, driver 32 preferably has a housing 33 and a positively driven output shaft 34. The output shaft 34 of driver 32 is accessible from the exterior of housing 33 and terminates in a free-end 34*a*. Like the free-end 34*a*, the opposite free-end of the driven output shaft (not shown) of driver 32 likewise extends beyond the exterior of housing 33. The output shaft 34 of system 30 defines a fixed rotational axis 37. The output shaft 34 of driver 32 is positively driven in at least one rotational direction about axis 37 and can be positively returned about axis 37 in an opposite rotational direction. In a preferred form, each free-end of output shaft 34 defines an end face 36 extending generally normal or perpendicular to the rotational axis 37 of shaft 34.

The door operating system 30 of this invention disclosure also includes a modular linkage system 40 extending from and operably connecting door 10 with the output shaft 34 of the powered driver 32. The modular linkage system 40 includes a series of different components which are connectable to each other in a variety of different arrangements and configurations whereby allowing the various components of the modular linkage system 40 to be used in any of a myriad of different situations to operably connect the output shaft 34 of the powered driver 32 to the door 10 (FIGS. 1 and 2).

Figure 3:
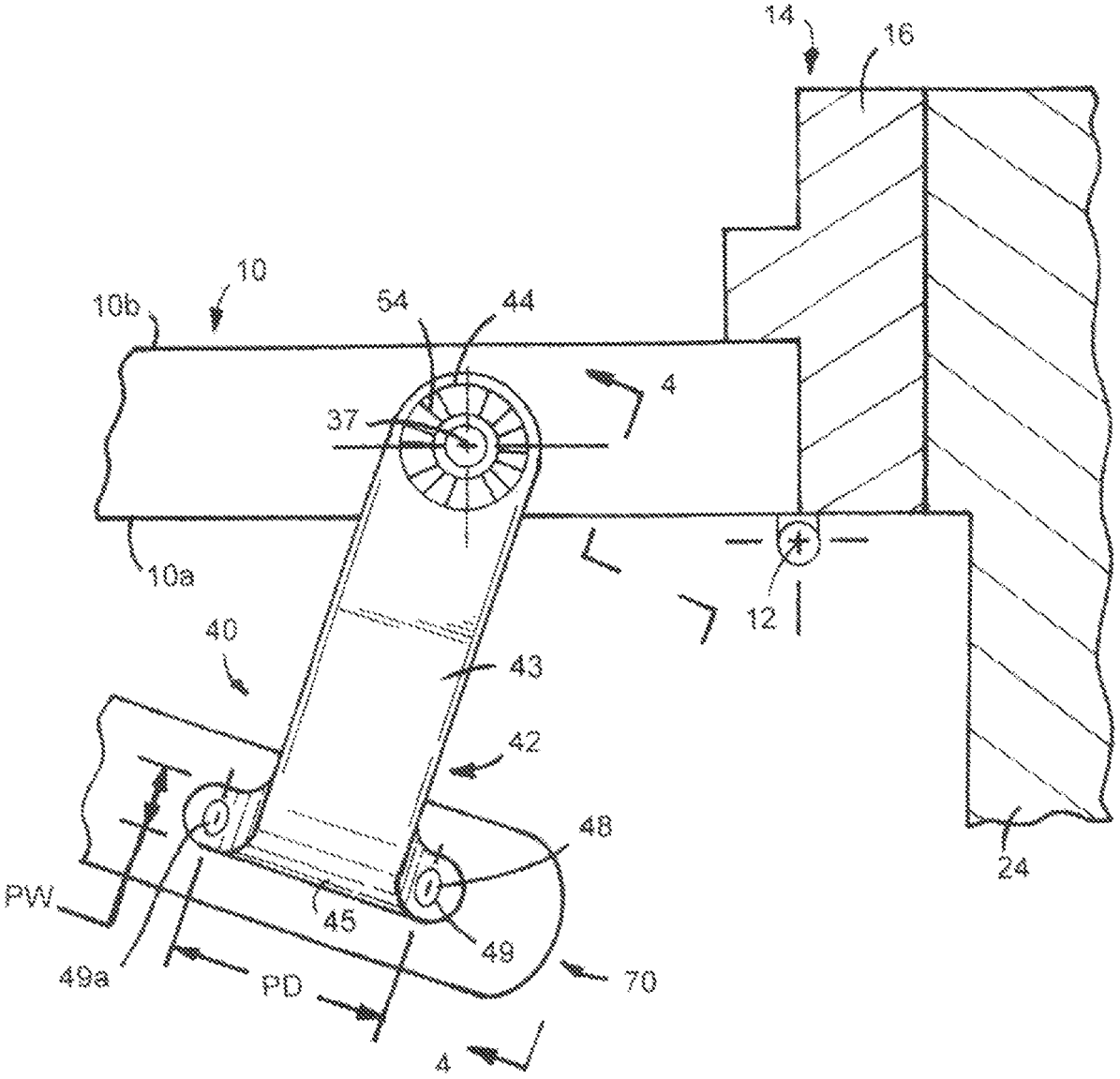
FIG. 3 is an enlarged and fragmentary top plan view showing one arrangement of the modular linkage system illustrated in FIG. 1.
Figure 4:
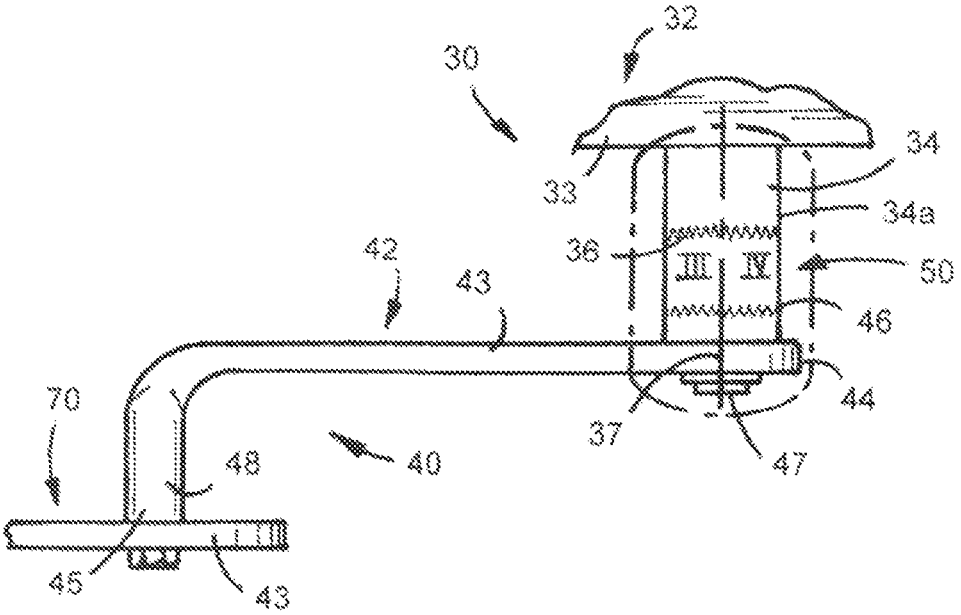
FIG. 4 is an enlarged and fragmentary side elevational view taken along line 4-4 of FIG. 3.

As illustrated in FIGS. 3 and 4, the modular linkage system 40 includes a preferably rigid, generally L-shaped crank arm component 42 including an elongated first arm 43 and a second arm 45 extending in generally perpendicular relationship relative to each other. Toward a free-end 44, the first arm 43 of the crank arm component 42 is operably connected to and driven by the free-end of the output shat 34 of driver 32 (FIG. 4). Also, the free-end 44 of the crank arm component 42 defines an end face 46 extending generally parallel to the end face 36 on the output shaft 34 of the powered driver 32 when the crank arm component 42 is operably connected to the output shaft 34 of driver 32. Moreover, and when the operating system 30 is operably connected to the door 10 (FIGS. 1 and 2), the free-end 44 of the crank arm component 42 of linkage system 40 directly underlies the free-end of the output shaft 34 of driver 32 (FIG. 4). A suitable fastener 47 serves to releasably and operably connect the free end 44 of the crank arm 42 to the output shaft 34 of driver 32 such that when shaft 34 is rotatably driven, the crank arm 42 is likewise driven.

As illustrated in FIGS. 3 and 4, the second arm 45 of the crank arm component 42 preferably defines and terminates in a base 48. The base 48 of crank arm component 42 has a predetermined width PW. For purposes described below, the base 48 of crank arm component 42 defines internally threaded bores 49, 49*a* which are spaced from each other by a predetermined distance PD.

Figure 5:
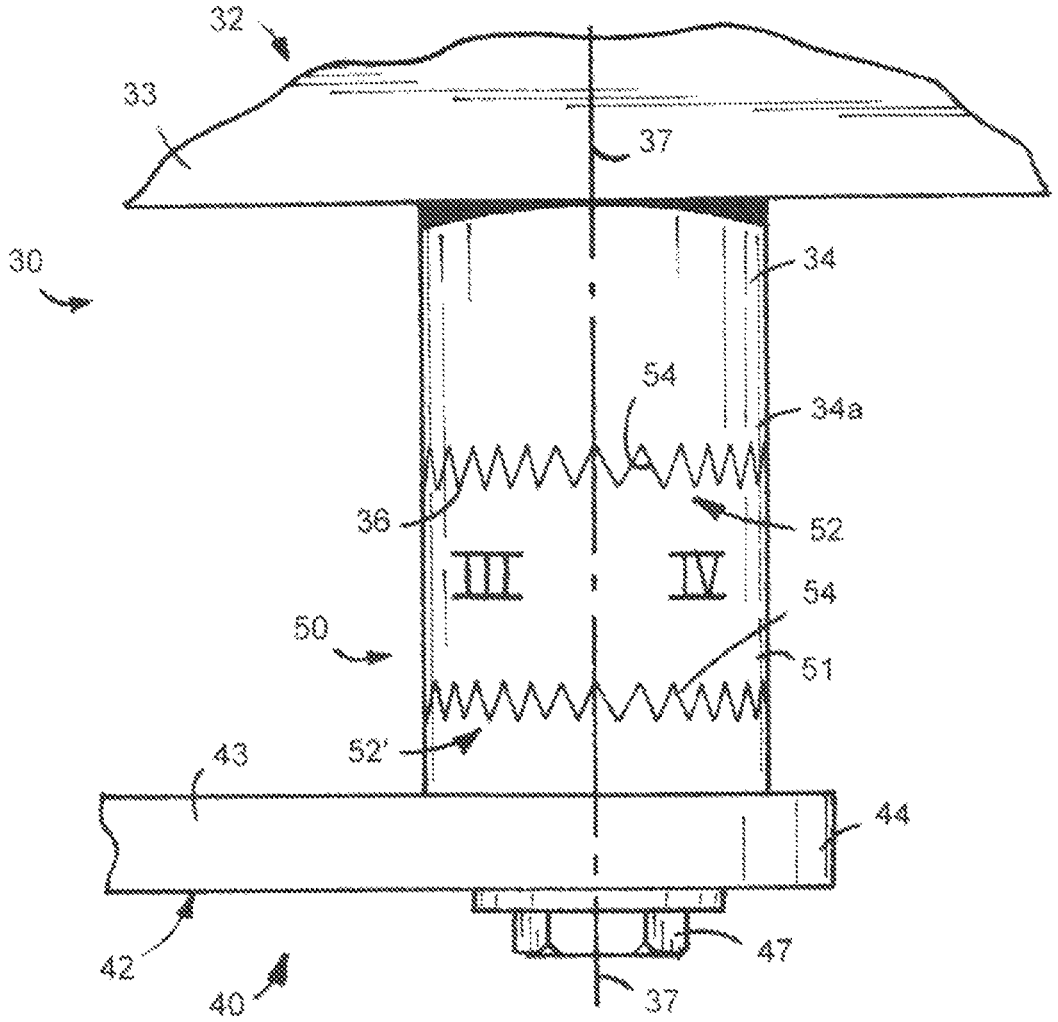
FIG. 5 is another enlarged and fragmentary side elevational view of the area encircled in phantom lines in FIG. 4.

In the embodiment shown by way of example in FIGS. 4 and 5, an adjustable and selectively operable coupling 50 can be disposed between the free-end 34*a* of the output shaft 34 of driver 32 and the free-end 44 of component 42 whereby allowing for a high resolution, angular adjustment of the position of door 10 (FIGS. 1 and 2). The arrangement of the operable coupling 50 between the free-end 34*a* of the output shaft 34 of driver 32 and the free-end 44 of the crank arm component 42 is more fully described in our copending U.S. patent application Ser. No. 16/857,582 entitled DOOR OPERATING SYSTEM, filed concurrently herewith; with the full teachings and principals of our copending patent application Ser. No. 16/857,582, being incorporated herein by reference.

Preferably, coupling 50 is configured as a metal ring 51 selectively rotatable about the axis 37 defined by the output shaft 34 of driver 32. Suffice it to say, the coupling 50 provides at least two adjustable interfaces 52 and 52' between the free-end of the output shaft 34 of driver 32 and the free-end 44 of the crank arm component 42. In the embodiment illustrated by way of example in FIG. 5, each interface 52, 52' between the between the free-end of the output shaft 34 of driver 32 and the free-end 44 of the crank arm component 42 includes a predetermined number of engagement features 54. That is, each end face 36 of the output shaft 34 of driver 32 has a series of engagement features 54 thereon. The engagement features 54 between the end face 36 of the output shaft 34 and the end face 46 on free-end 44 of the crank arm component 42 are configured to positively and mutually engage with the confronting engagement features on the metal ring 51 and each other in any of a plurality of distinct angularly indexed positions about fixed axis 37.

Preferably, the engagement features or elements included with the interfaces 52 and 52' comprise a series of equally spaced, radial and intermeshing teeth which combine to define sets of interlocking instrumentalities therebetween which intermesh with each other as long as fastener 47 releasably holds the parts in clamped relationship relative to each other.

Figure 6:
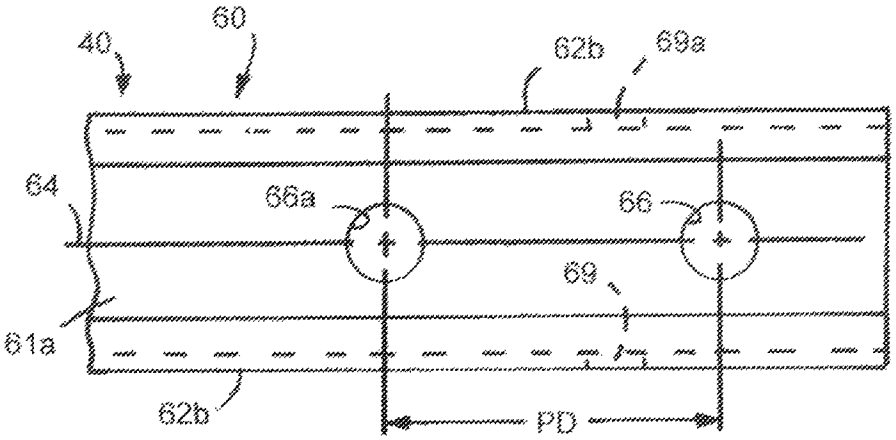
FIG. 6 is an enlarged and fragmentary top plan view of one form of an elongated track component forming part of the modular linkage system.
Figure 8:
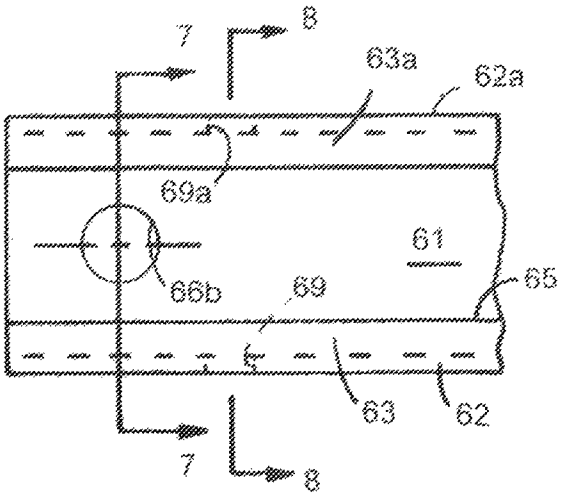
FIG. 8 is a sectional view taken along line 8-8 of FIG. 6.
Figure 8:
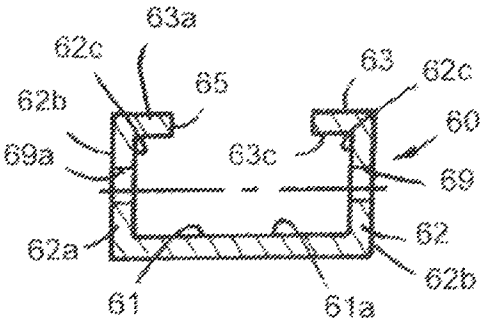
Figure 7:
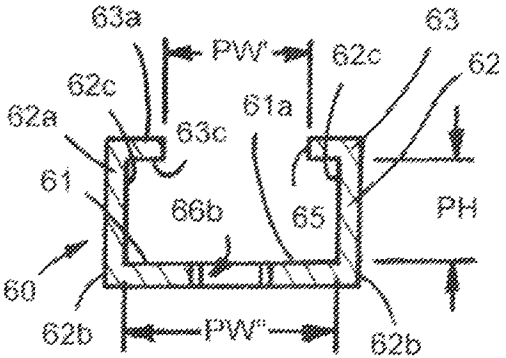
FIG. 7 is a sectional view taken along line 7-7 of FIG. 6.

The modular linkage system 40 also includes a rigid and axially elongated track component 60 illustrated by way of example in FIG. 6. In the example illustrated in FIGS. 6, 7 and 8, track component 60 has a generally flat bottom wall 61 along with two laterally spaced side walls 62 and 62*a* rigidly joined to and extending in the same direction from the bottom wall 61. The side walls 62, 62*a* each have a generally planar outer surface configuration 62*b*. As illustrated in FIGS. 7 and 8, each side wall 62, 62*a* has a generally planar inner surface configuration 62*c*. Moreover, each side wall 62, 62*a* of the track component 60 has a top wall section 63, 63*a* joined to and extending from the respective side wall and toward a longitudinal centerline 64 of component 60. The top wall sections 63, 63*a* extend generally coplanar relative to each other so as to provide component 60 with an elongated channel 65 which is open toward opposed ends thereof and has a generally C-shaped cross-sectional linear configuration.

As illustrated in FIG. 7, the channel 65 defined by the track component 60 has a predetermined width PW' defined between the opposed interior surfaces 62*c* of the side walls 62, 62*a*. As illustrated in FIG. 7, the free terminal ends of the top wall sections 63, 63*a* are separated from each other by a predetermined PW which is equal to or slightly greater than the predetermined width PW (FIG. 3) at the base 48 of component 42. As such, and in the alternative configuration illustrated in FIG. 23, the base 48 of the crank arm component component 42 can be accommodated and secured within the track component channel 65 in one of the multitude of alternative arrangements of the modular linkage system 40. As such, and in the alternative configuration of the modular linkage assembly 40 illustrated in FIG. 23, when the crank arm component 42 is positively rotated by the powered driver 32, the track component 60 is also positively driven. Returning to FIG. 7, the channel 65 defined by track component 60 also has predetermined height PH between an interior surface on the bottom wall 61 and an underside 63*c* of the top wall sections 63, 63*a*.

The rigid and axially elongated track component 60 is furthermore configured so as to readily accommodate an operable association between the track component 60 on either side of the door 10, and various other components comprising the modular linkage system 40 in alternative configurations whereby significantly enhancing the versatility of the modular linkage system 40. As illustrated by way of example in FIG. 6, and toward one end thereof, the bottom wall 61 of track component 60 is configured with throughbores 66, 66*a* which open to the channel 65. The throughbores 66, 66*a* are spaced apart from each other by a predetermined distance PD generally equal to the same predetermined distance PD (FIG. 3) the internally threaded bores 49, 49*a* defined by the base 48 of the crank arm component 42 are spaced from each other whereby allowing suitable fasteners 67 (FIG. 2) to be used to secure the base 48 of crank arm component 42 toward one end of the track component 60 in one of the multitude of arrangements of the modular linkage system 40. As illustrated by way of example in FIG. 6, and toward an end opposite from through bores 66, 66*a*, the bottom wall 61 of track component 60 defines through at least one through bore 66*b* which also opens to channel 65.

Returning to the preferred embodiment of the track component 60 illustrated in FIGS. 6 and 8, and to further enhance the versatility of the modular linkage system 40, each side wall 62, 62*a* of the track component 60 defines a pair of longitudinally spaced bores or openings 69, 69*a*, respectively, disposed toward opposite ends thereof. Notably, each pair of bores or openings 69, 69*a* defined toward each end of the track component 60 by walls 62, 62*a* are laterally aligned relative to each other whereby allowing a conventional headed fastener, like fastener 68 (FIG. 1) or the like, to pass therethrough and secure the elongated track component 60 to a flat surface of the door 10 in an alternative configuration of the modular track system 40.

The modular linkage system 40 also includes a rigid and axially elongated multilink component 70. Component 70 has opposed ends 71 and 72. Additionally, and to enhance the versatility of the modular linkage system 40, an overall length OL (FIG. 9), i.e., the length between the opposed ends 71 and 72 thereof, is adjustable.

Figure 9:
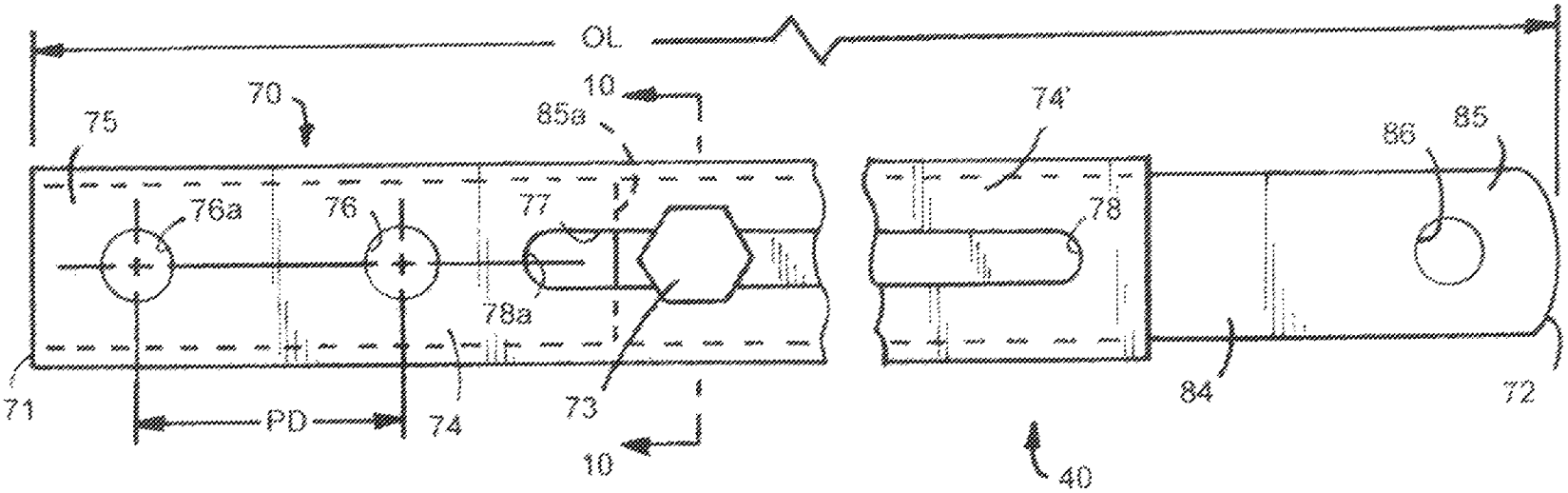
FIG. 9 is an enlarged and fragmentary top plan view of one form of a multilink component forming part of the modular linkage system.
Figure 10:
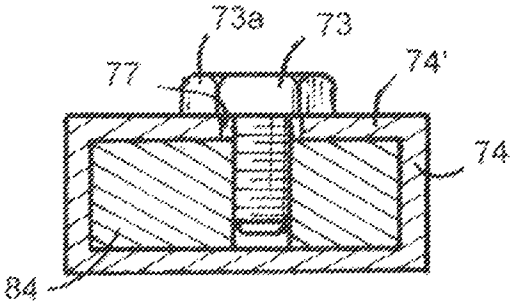
FIG. 10 is a sectional view taken along line 10-10 of FIG. 9.

In a preferred embodiment illustrated in FIGS. 9 and 10, the axially elongated multilink component 70 includes first and second elongated pieces or links 74 and 84 whose independent lengths are preferably shorter than the overall length of the multilink component 70 so as to allow the links 74 and 84 of the multilink component 70 to be arranged in adjustable sliding and preferably telescopic relationship relative to each other. A suitable fastener 73 having an enlarged head 73*a* is arranged in operable combination with the pieces 74 and 84 of the multilink component 70 to adjustably and releasably fix or secure the overall length OL of the multilink component 70 as desired or required depending upon the variation of the modular linkage assembly 40 selected.

As with track component 60, the multilink component 70 is configured to readily and quickly accommodate an operable association between it and other components of the modular linkage system 40 whereby enhancing the versatility of the modular linkage system 40. In one embodiment illustrated in FIG. 9, the first piece or link 74 of the multilink component 70 has a hollow and generally rectangular cross-sectional configuration extending the length thereof and which allows the second piece 84 of the multipiece link 70 to slide and be longitudinally guided therewithin. These Applicants appreciate, however, other cross-sectional configurations of the pieces 74 and 84 comprising the multilink component 70 would equally suffice without detracting or departing from the spirit and scope of this invention disclosure.

In the illustrated embodiment, and toward end 75, the first piece 74 of the multipiece link 70 defines throughbores 76, 76*a*. The throughbores 76, 76*a* are spaced apart from each other by a predetermined distance PD generally equal to the predetermined distance PD (FIG. 3) the internally threaded bores 49, 49*a* defined by the base 48 of the crank arm component 42 are spaced from each other. As such, and in the embodiment of the linkage assembly 40 illustrated in FIG. 1, suitable fasteners, such as fasteners 67 (FIG. 2) can secure base 48 of crank arm component 42 toward the end 75 of the first piece 74 of the multilink component 70 in one of the multitude of arrangements of the modular linkage system 40. Accordingly, the multilink component 70 will be driven and moved by the crank arm 42 in response to rotation of the drive shaft 34 of driver 32.

Preferably, and between its ends, an upper wall 74' (FIGS. 9 and 10) of the first piece 74 of the multilink component 70 defines a closed ended slot or channel 77 defining longitudinally spaced limit stops 78, 78*a* at opposed ends thereof. As will be appreciated from an understanding of this aspect of the invention disclosure, the stops 78, 78*a* on the first piece 74 of the multilink component 70 cooperate with the fastener 73 in limiting the overall length OL of the multilink component 70 between the longitudinally separated ends 71 and 72 thereof. Once the overall length OL of the multilink component 70 is selected, the beaded fastener 73 is tightened and serves to clamp or secure the pieces 74 and 84 to each other. Other designs for readily allowing for adjustment of the overall length OL of component 70 are intended to be protected and remain within the spirit and scope of this invention disclosure.

The second component piece 84 of the multilink component 70 is of rigid construction between its longitudinally spaced ends 85, 85*a* and is configured to be telescopically guided and slide longitudinally within piece 74 of the multilink component 70. Notably, the multilink component 70 is purposefully designed such that the end 85 of the second component piece 84 longitudinally extends beyond or outward from that terminal end of the first piece or link 74 opposite from the throughbores 76, 76*a*. In the illustrated embodiment, and toward end 85, the multilink component piece 84 defines a throughbore 86 which allows the second piece 84 of component 70 to be articulately interconnected to other components of and in various arrangements of the modular linkage system 40.

Moreover, the modular linkage system 40 includes a rigid block component 90 which operably combines with other components of system 40 to accommodate different connections of the linkage system 40 between door 10 (FIG. 1) and driver 32 (FIG. 2). Block component 90 is preferably fabricated from an elastomer type material, i.e, plastic, nylon or other types of thermo-elastomers to either enhance its guided slidability relative to the elongated track component 60 while offering both the strength and required rigidity so as to allow the block component to be secured in place in any of a myriad of different situations.

Figure 11:
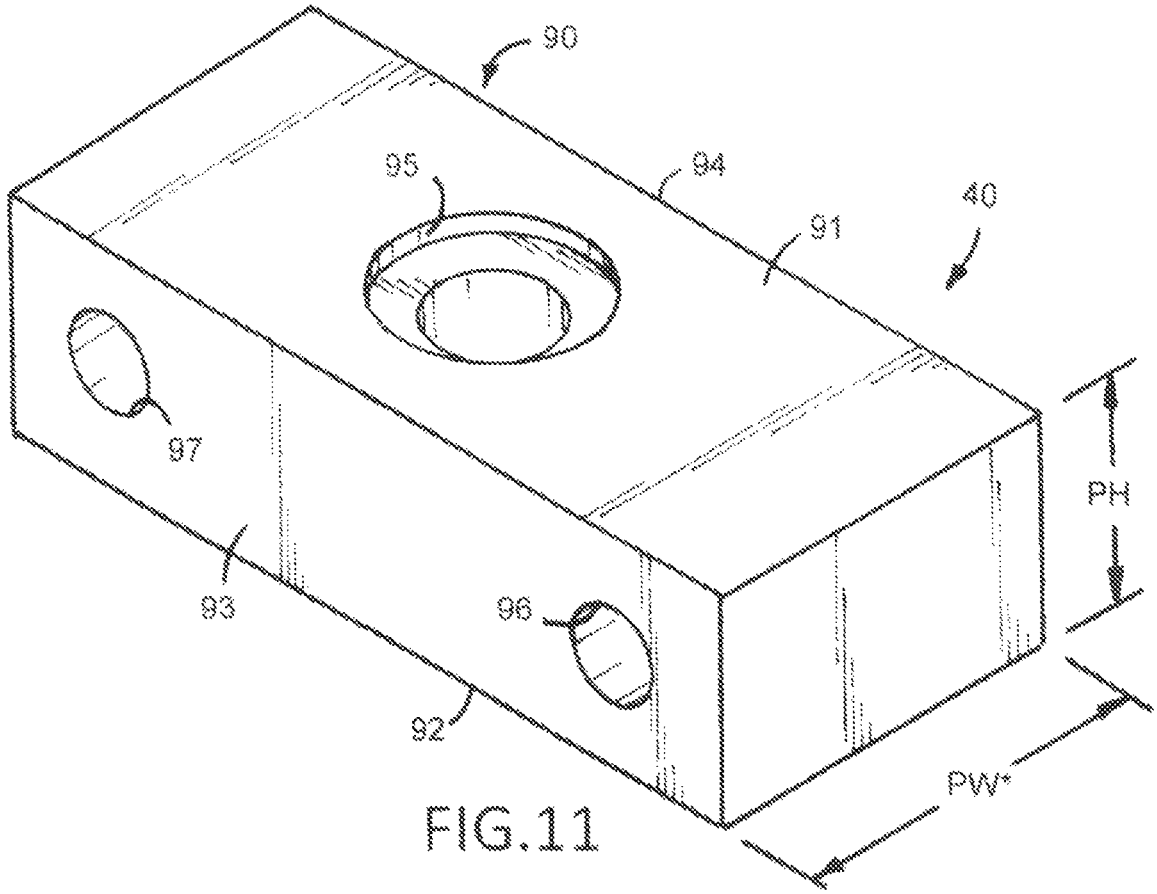
FIG. 11 is an enlarged top perspective view one form of a block component forming part of the modular linkage system.
Figure 15:
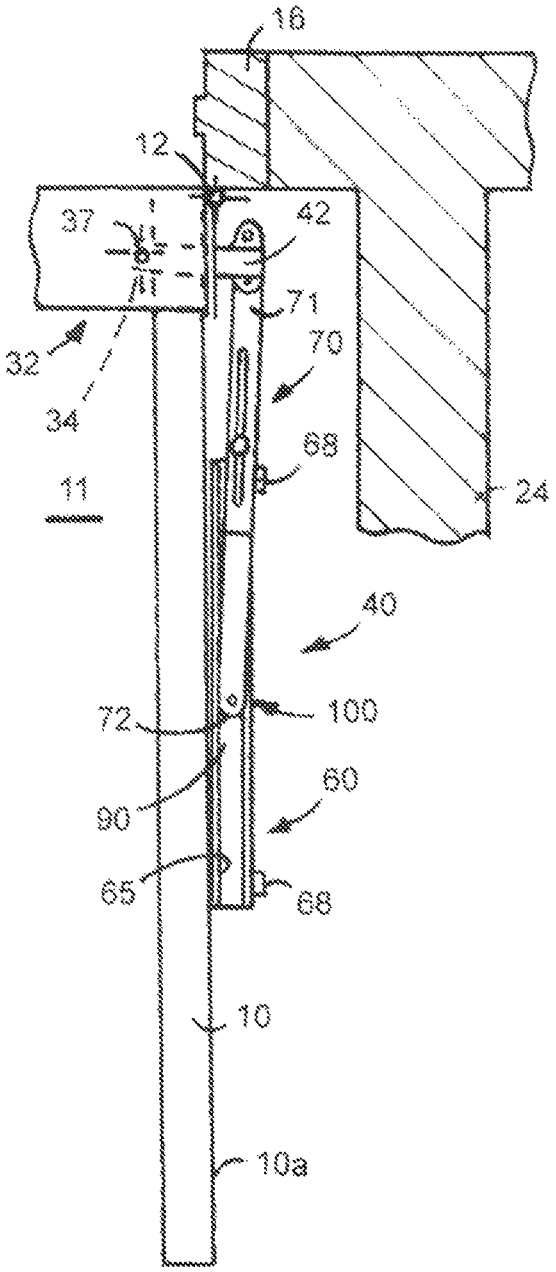
FIG. 15 is a top plan view, partly in section, similar to FIG. 1 but showing the relative arrangement of the modular linkage system components when the right-handed pull door shown in FIG. 1 is in an open position.

In the configuration or arrangement of the modular linkage assembly 40 illustrated in FIGS. 1 and 15, the block component 90 is configured to slidably move along, within and be guided by the elongated generally C-shaped channel 65 defined by the track component 60. As shown by way of example in FIG. 11, the block component 80 preferably has a generally rectangular configuration including upper and lower generally planar surfaces 91 and 92, respectively, along with front and rear sides 93 and 94, respectively. To allow component 90 to be guided by and slide within the elongated channel 65 defined by the elongated track component 60 (FIGS. 1 and 6), and as illustrated in FIG. 11, the block component 90 has a predetermined height PH between the upper and lower surfaces 91 and 92, respectively, which is generally equal to or slightly less than the predetermined height PH (FIG. 7) between an interior surface 61*a* on the bottom wall 61 of the track component 60 and the underside 63*c* of each top wall section 63, 63*a* of the track component 60 FIG. 7). Moreover, component 90 has a predetermined width PW* (FIGS. 11 and 12) slightly less than the PW" (FIG. 7) defined between the interior and upstanding surfaces 62*c* on the side walls 62, 62*a* of component 60.

Figure 12:
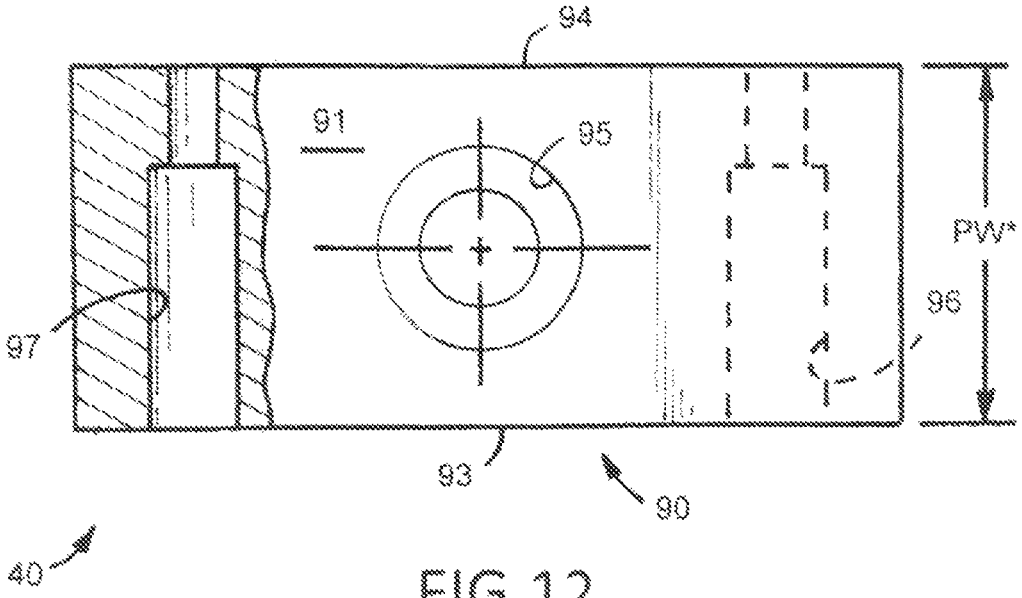
FIG. 12 is a top plan view, partly in section, of the block component illustrated in FIG. 11.

Moreover, and in a preferred embodiment illustrated by way of example in FIGS. 11 and 12, block component 90 defines a generally centralized counterbore 95 opening to both the upper and lower generally planar surfaces 91 and 92, respectively, of component 90 so as to journal a pivot pin 102 forming part of a pivot pin assembly 100 (FIG. 13) in one alternative configuration of the modular linkage assembly 40. For purposes discussed below, and in a preferred embodiment shown by way of example in FIG. 12, block component 90 defines two counterbores 96 and 97 which each open to both the front and rear sides 93 and 94, respectively, of component 90. In another alternative configuration of the modular linkage system 40, and as discussed below, the counterbores 96, 97 (FIG. 10) allow the same fasteners 68 (FIG. 13) used to secure track component 60 to the door 10 to pass therethrough as to secure the block component 90 to a flat surface 10*a* on door 10 (FIG. 12) through use of fasteners 68.

In the configuration of the modular linkage illustrated by way of example in FIG. 1, pin assembly 100 articulately interconnects end 85 of the second piece 84 of the multilink component 70 to the block component 90. Pin assembly 100 can take any of a myriad of different designs without detracting front the true spirit and novel scope of this invention disclosure. In the modular linkage system 40 embodiment illustrated in FIGS. 1 and 13, the block component 90 is captured for sliding movements within and between the opposed ends of channel 65 defined by the elongated track component 60. In the configuration of the modular linkage system 40 illustrated in FIG. 1, the elongated track component 60 is suitably secured to a flat surface on an interior side 10 of door 10 through use of fasteners 68.

Figure 13:
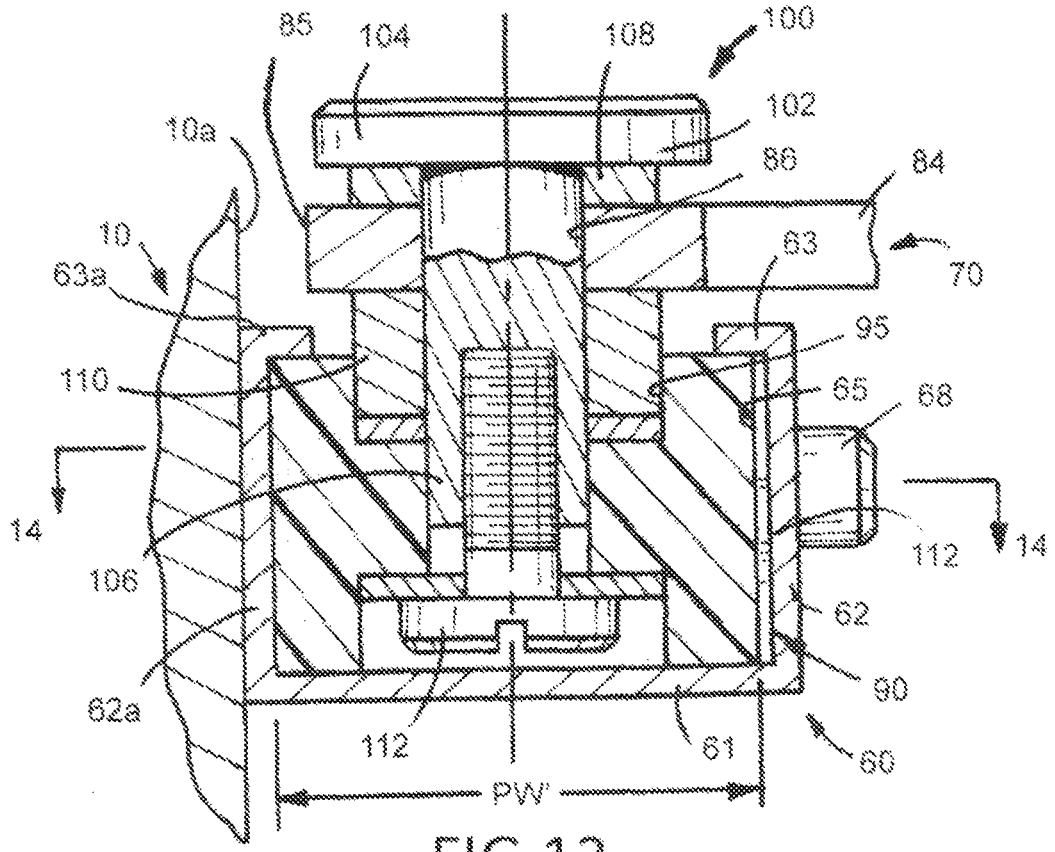
FIG. 13 is an enlarged sectional view taken along line 13-13 of FIG. 1.

Returning to the example shown in FIG. 13, the pin assembly 100 used to articulately interconnect the free end 85 of the second piece/link 84 of the multilink component 70 to the block component 90 includes a pin 102 having an enlarged head 104 and shank 106. The shank 106 of pin 102 extends through the bore 86 defined by and toward the second end 85 of the second piece/link 84 of the multilink component 70 and depends into the block component 90. Suitable spacers 108 and 110 are arranged about the shank 106 of pin 102 and beneath the head 104 so as to provide appropriate clearances. A suitable clamping fastener 112 is arranged in operable combination with a free-end of the shank 106 of pin assembly 100 whereby articulately securing the free end of the second piece/link 84 of the multilink component 70 to the block component 90. As mentioned, and in the linkage configuration illustrated in FIG. 1, the opposite end of the multilink component 70 is fastened to the base 48 of the crank arm component 42.

In those arrangements of the modular linkage system 40 wherein the block component 90 is adapted to slide within the channel 65 of the elongated track component 60 (FIG. 6), the block component 90 is designed to enhance the slidability thereof within the channel 65 of the elongated track 60. As will be appreciated from an understanding of the present invention disclosure, in one arrangement of the modular linkage system 40, the block component 90 is adapted to slide within the channel 65 of the elongated track component 60. Toward those ends, block component 90 is preferably spring biased toward one of the side walls 62, 62*a* of the track component 60.

Figure 14:
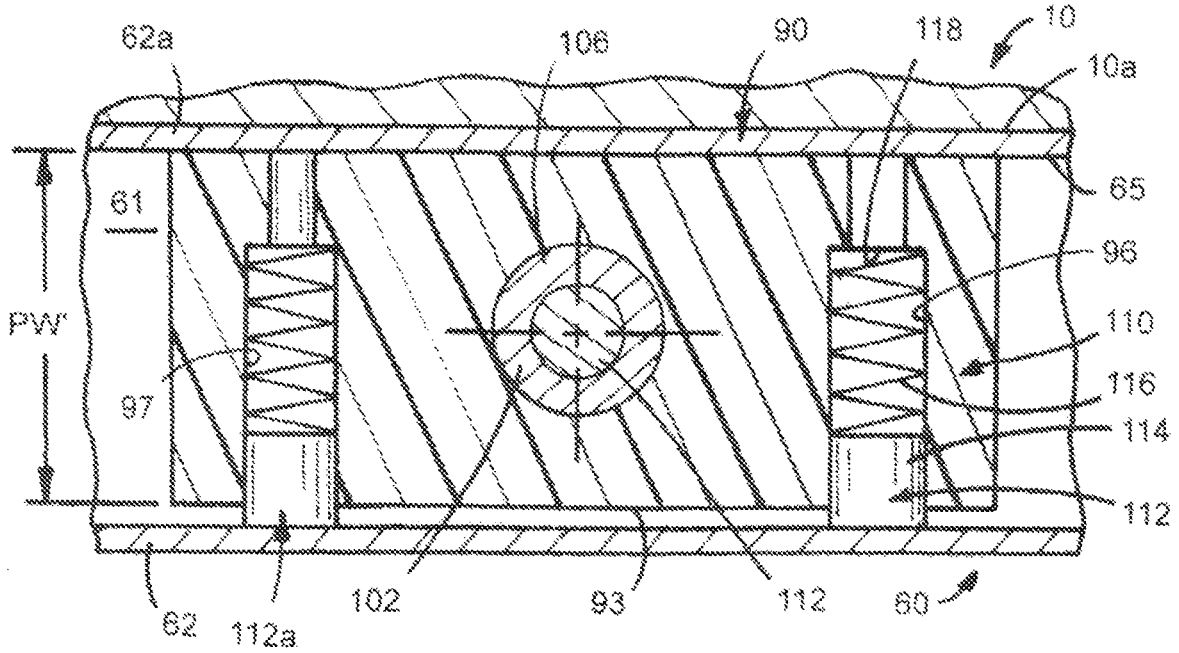
FIG. 14 is a sectional view taken along line 14-14 of FIG. 13.

Turning to FIG. 14, in those arrangements or embodiments of the modular linkage system 40 wherein the block component 90 is adapted to slide within channel 65 of the elongated track component 60, the block component 90 includes a spring mechanism 110 for aiding the desired ends. As with other aspects of this invention disclosure, spring mechanism 110 can take any of a myriad of different designs from that illustrated for exemplary purposes without detracting or departing from the true spirit and novel scope of this invention disclosure.

As illustrated by way of example in FIG. 14, spring mechanism 110 includes a pair of spring biased plungers 112 and 112*a* arranged within the counterbores 95 and 96, respectively, defined by the block component 90. Preferably, the spring plungers 112, 112*a* are substantially identical relative to each other. As such, only spring plunger 112 will be described in detail. Each spring plunger includes a plunger 114 which is adapted to extend slightly beyond the side 93 of the block component 90 so as to add stability to the block component 90 as it slides within the channel 65 defined by the elongated track component 60. Each plunger 114 is preferably made from a wear resistant elastomer material such as plastic, nylon or suitable UHMW material. After being arranged within channel 65 defined by the elongated track component 60, the block component 90 is urged in one direction by a suitable compression spring 116 arranged between the plunger 114 and a radial shoulder 118 defined by the respective counterbore 95 and 96 in the block component 90.

To open the right-handed pull door 10 illustrated in FIG. 1, the output shaft 34 of the powered driver 32 is rotatably driven about axis 37 (FIGS. 1 and 2) whereby angularly driving the crank arm component 42 of the modular linkage system 40 from the position schematically illustrated in FIG. 1 toward the position illustrated in FIG. 15. As the crank arm component 42 of the modular linkage system 40 is positively driven and moves toward the position illustrated in FIG. 15, the multipiece link component 70, as a result of being connected to the crank arm component 42, pulls the block component 90 through the channel 65 defined by the elongated track component 60 whereby imparting a pulling opening force on door 10.

As illustrated in FIG. 15, by having the block component 90 slide along the channel 65 defined by the elongated track component 60, the operational or functioning area or space within which the modular linkage system 40 works, is minimized between the interior side 10*a* of the door 10 and the adjacent wall 24. By minimizing the space constraints wherein the modular linkage system works and operates, the door 10 can be moved to a fully open position to optimize access to and from the interior of room 11.

Figure 16:
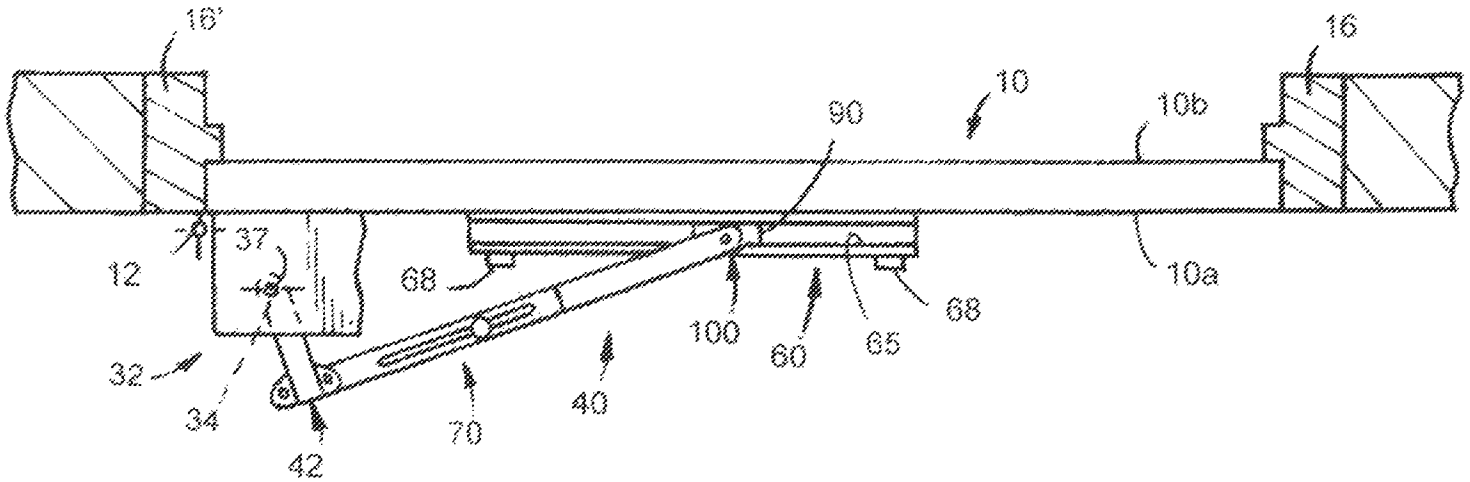
FIG. 16 is a view, partly in section, of an alternative arrangement of the modular linkage system comprised of the same components as illustrated in FIG. 1 but connected to a closed left-handed pull door wherein a pivot axis for the door and the connected driver are arranged toward an interior side of the door.

Turning now to FIG. 16, there is shown a different door arrangement from that illustrated in FIGS. 1 and 15. Albeit different from the door arrangement shown in FIGS. 1 and 15, the modular linkage system 40 of the present invention disclosure advantageously uses the same components as was used with the door arrangement shown in FIGS. 1 and 15 in a different arrangement or configuration for positively pulling the door 10 from the closed position illustrated in FIG. 16 to the open position illustrated in FIG. 17. That is, despite several structural differences between the door arrangement shown in FIG. 1 and the door arrangement shown in FIG. 16 including the different arrangement of the powered driver 32 and the different location of the pivot axis 12, the modular linkage system 40 advantageously allows use of the same crank arm component 42, the same elongated track component 60, the same multilink component 70, and the same rigid block component 90 as discussed in detail above regarding that shown in FIG. 1 to interconnect the left-handed pull door 10 to the powered driver 32.

In the arrangement illustrated by way of example in FIG. 16, one end of the same crank arm component 42 illustrated and discussed above is secured to the output shaft 34 of driver 32. An opposite end of the same crank arm component 42 illustrated and discussed above is connected to one end of the same adjustable multilink component 70 illustrated and discussed above. After adjusting the operative length OL of the multipiece linkage 70, the same pin assembly 100 illustrated and discussed above can serve to articulately connect an opposite end of the adjustable multilink component 70 to the block component 90. As will be appreciated from an understanding of this invention disclosure, the block component 90 used in operable combination with the modular linkage system 40 is the same component illustrated and discussed above with the linkage arrangement illustrated in FIG. 1. A schematically illustrated in FIG. 16, the block component 90 is slidably arranged within the confines of the elongated channel 65 in the same elongated track component 60 illustrated and discussed regarding the linkage system shown in FIG. 1 and the elongated track component 60 is secured or connected to the interior side 10*a* of door 10.

Figure 17:
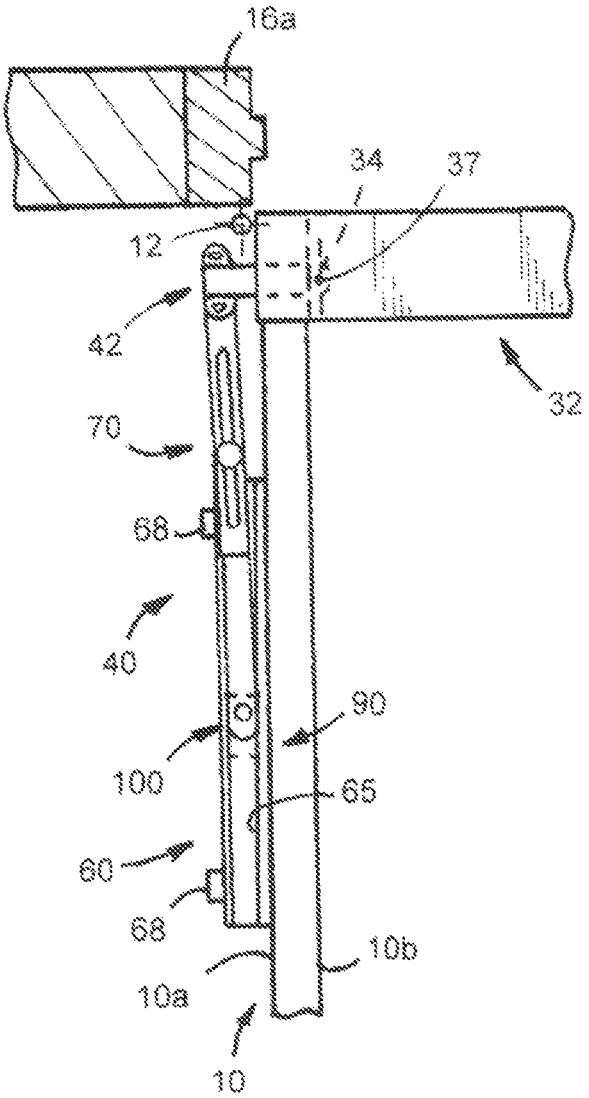
FIG. 17 is a view, partly in section, similar to FIG. 16 but showing the relative arrangement of the modular linkage system components when the left-handed pull door shown in FIG. 16 is in an open position.

To open the left-handed pull door 10 toward the position illustrated in FIG. 16, the output shaft 34 of the powered driver 32 is rotated in an appropriate direction about axis 37 whereby angularly driving the crank arm component 42 of the modular linkage system 40 from the position illustrated in FIG. 16 toward the position schematically illustrated in FIG. 17. As the crank arm component 42 of the modular linkage system 40 moves toward the position illustrated in FIG. 17, the multilink component 70 pulls the block component 90 through the channel 65 defined by the elongated track component 60 while imparting a pulling opening force or action on the door 10.

After comparing FIGS. 1 and 15 with FIGS. 16 and 17, it will be readily apparent the same modular linkage system components comprising the linkage assembly of the present invention disclosure can be advantageously used to readily and consistently move either a right-handed pull door or a left-handed pull door between closed and open positions. As such, the repair person and manufacturer of such devices who are responsible for making, purchasing, storing, inventorying and using multiples of the different components for different door operating systems can now use but a unique modular system adaptable in a myriad of different arrangements and which can be set in a variety of different patterns or designs to accomplish that which would normally require a multitude of different parts to accomplish the same result.

Figure 18:
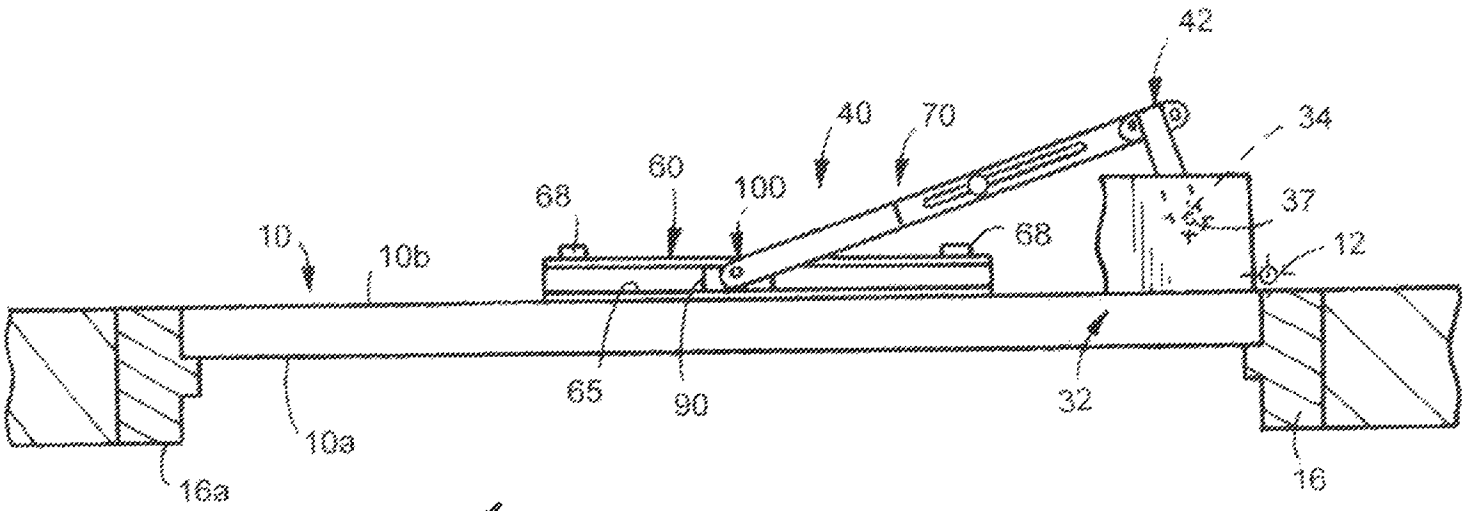
FIG. 18 is a view, partly in section, of an alternative configuration of the same modular linkage system comprised of the same components as illustrated in FIG. 1 but connected to a closed right-handed pull door wherein a pivot axis for the door and the connected driver are arranged toward an exterior side of the door.
Figure 19:
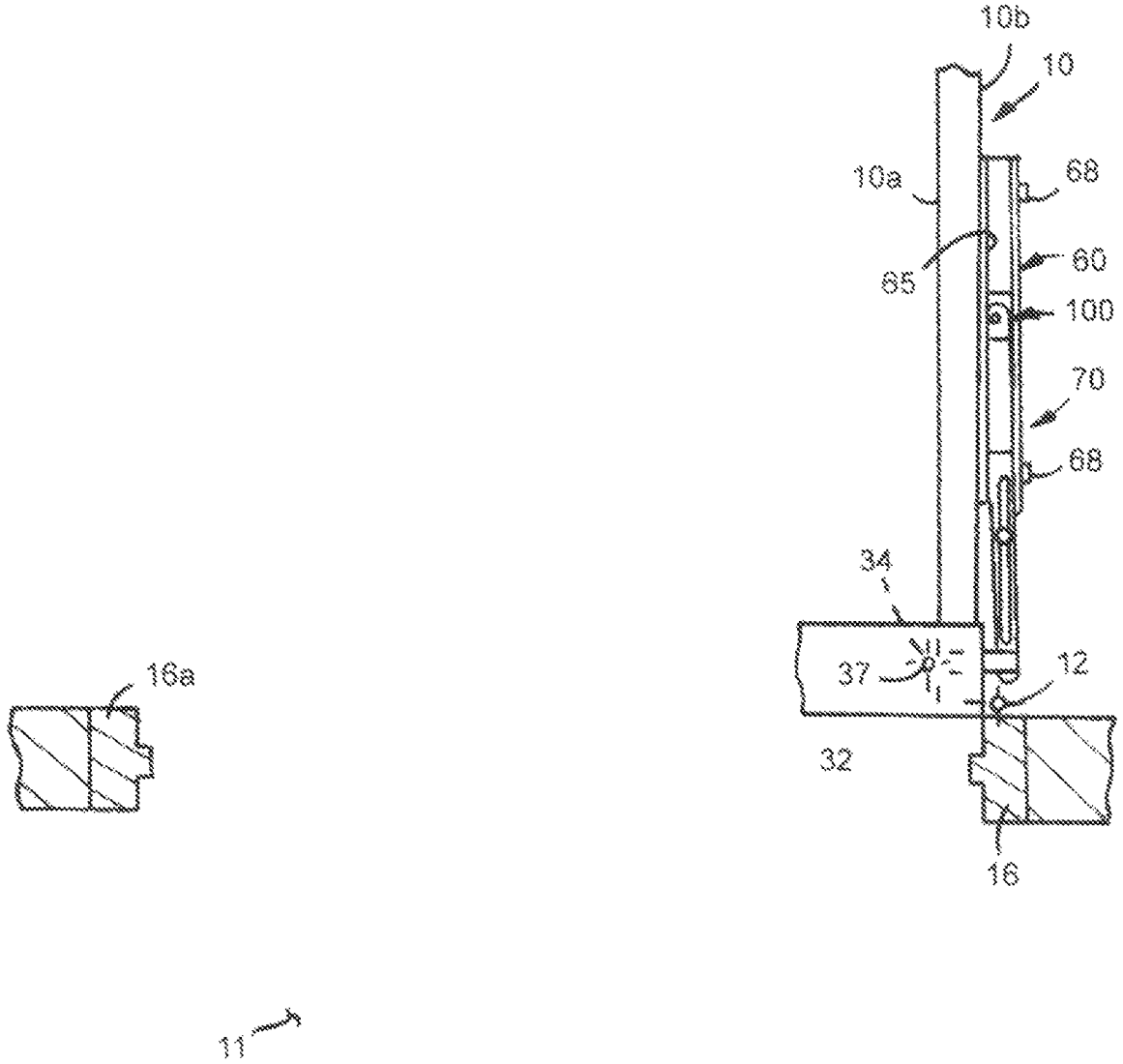
FIG. 19 is a view, partly in section, similar to FIG. 18 but showing the relative arrangement of the modular linkage system components when the left-handed pull door shown in FIG. 18 is in an open position.

Another example of the modularity aspect offered by and which is uniquely inherent with the present invention disclosure is set forth in FIGS. 18 and 19. Unlike the door arrangement illustrated in either FIG. 1 or FIG. 16, there is schematically shown in FIGS. 18 and 19, a right-handed door pull arrangement where the pivot axis 12 of door 10 and the powered driver 32 are both arranged toward an exterior 10*b* side of the door 10. FIGS. 18 and 19, however, schematically illustrate advantageously using the same components of the modular linkage system 40, as discussed above, for positively pulling the right-handed door from the closed position illustrated in FIG. 18 to the open position illustrated in FIG. 19. That is, and despite several structural differences between the door arrangement shown in either FIG. 1 or FIG. 16 with the door arrangement in FIGS. 18 and 19 including the different arrangement of the door pivot axis 12 along with the position of the powered driver 32, the modular linkage system design set forth by the present invention disclosure advantageously allows using the same crank arm component 42, the same elongated track component 60, the same multilink component 70, and the same rigid block component 90, as discussed in detail above, to interconnect the right-handed pull door 10 to the powered driver 32 arranged toward an exterior of the door 10.

In the arrangement illustrated by way of example in FIG. 18, one end of the same crank arm component 42 illustrated and discussed above is secured to the output shaft 34 of driver 32. Notably, however, in the embodiment illustrated in FIGS. 18 and 19, and because the driver 32 is mounted to an exterior side of the door 10 rather than to an interior side of the door 19 (as schematically illustrated in FIGS. 1, 15, 16 and 17), the angular disposition or orientation of the generally L-shaped crank arm component 42 has been simply reversed from that schematically illustrated in FIGS. 1, 15, 16 and 17 to easily and readily accommodate the change in the disposition of the driver 32 relative to the door 10. An opposite or free-end of the same crank arm component 42 illustrated and discussed above is connected to one end of the same adjustable multilink component 70 illustrated and discussed above. After adjusting the operative length OL (FIG. 9) of the multipiece linkage 70, the same pin assembly 100 illustrated and discussed above serves to articulately connect an opposite end of the adjustable multilink component 70 to the block component 90. As will be appreciated from an understanding of this invention disclosure, the block component 90 used in operable combination with the modular linkage system 40 is the same component illustrated and discussed above with the linkage arrangement illustrated in FIG. 1 and FIG. 16. A schematically illustrated in FIG. 18, the block component 90 is slidably arranged within the elongated channel 65 in the same elongated track component 60 illustrated and discussed regarding the linkage system shown in FIG. 1 and FIG. 16 and the elongated track component 60 is secured or connected to the exterior side 10*b* of door 10.

To open the right-handed pull door 10 illustrated in FIG. 18, the output shaft 34 of the powered driver 32 is rotated in an appropriate direction about axis 37 whereby angularly driving the crank arm component 42 of the modular linkage system 40 from the position illustrated in FIG. 18 to the position schematically illustrated in FIG. 19. As the crank arm component 42 of the modular linkage system 40 moves toward the position illustrated in FIG. 19, the multilink component 70 pulls the block component 90 through the channel 65 defined by the elongated track component 60 while imparting an opening force or action on the door 10.

Figure 20:
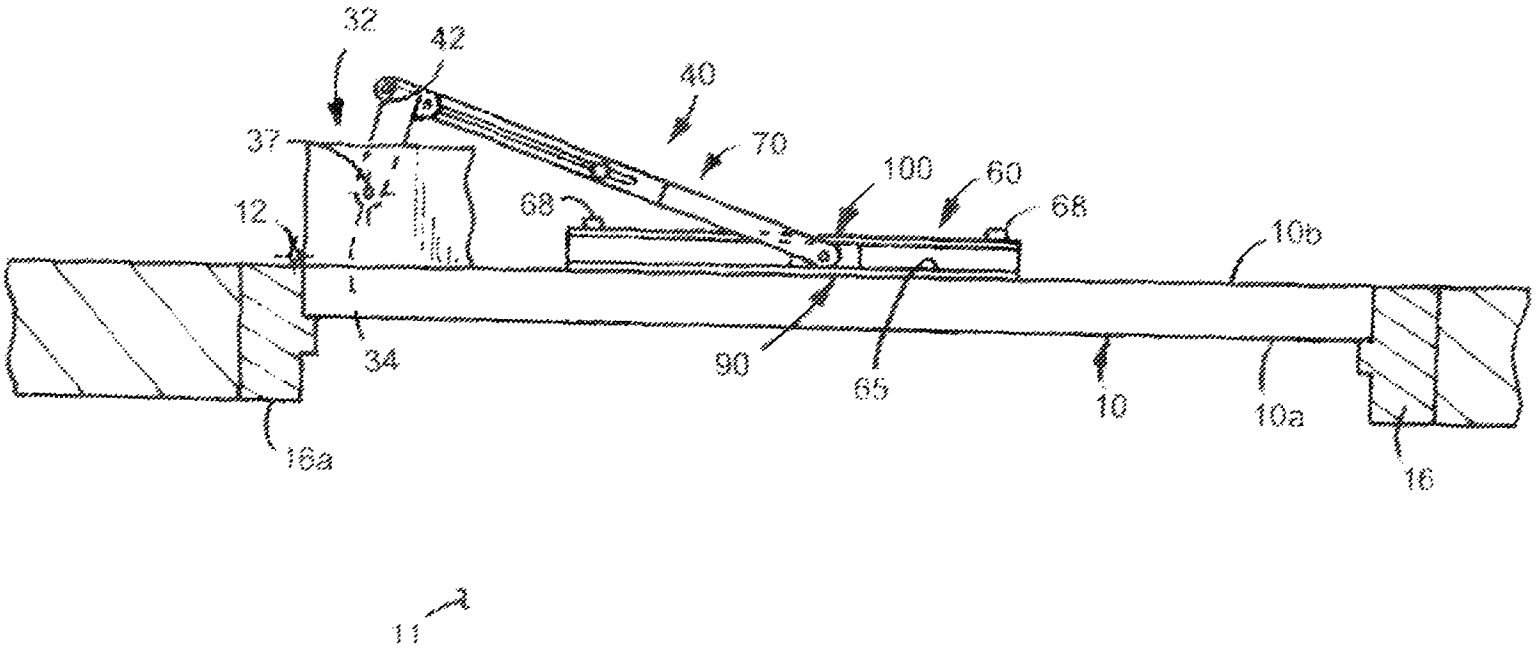
FIG. 20 is a view, partly in section, of an alternative configuration of the same modular linkage system comprised of the same components illustrated in FIGS. 1 and 16 but connected to a closed left handed-pull door wherein a pivot axis for the door and the connected driver are arranged toward an exterior side of the door.
Figure 21:
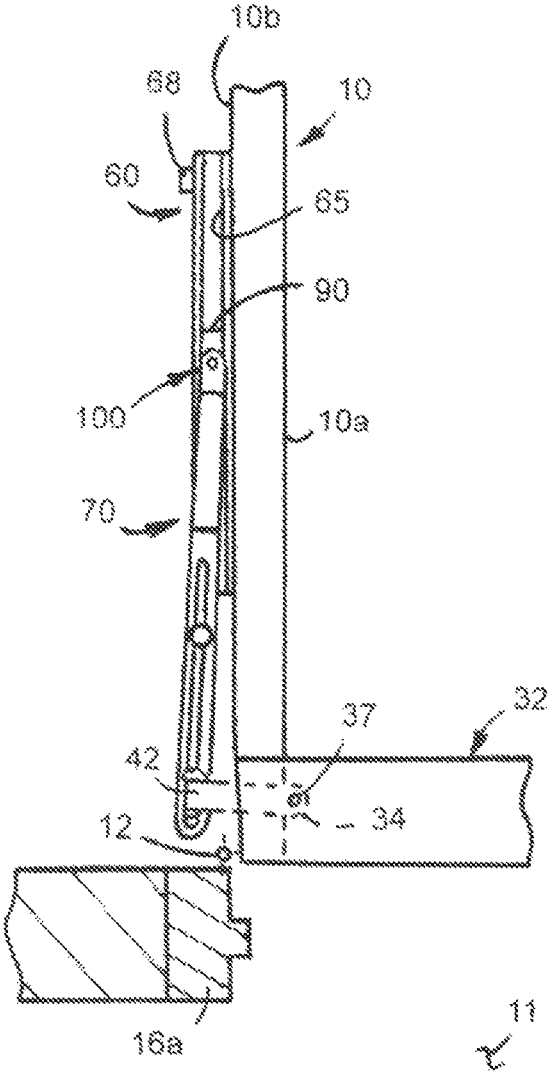
FIG. 21 is a view, partly in section, similar to FIG. 18 but showing the relative arrangement of the modular linkage system components when the left-handed pull door shown in FIG. 18 is in an open position.

Still another example of the modularity aspect offered by and which is uniquely inherent with the present invention disclosure is set forth in FIGS. 20 and 21. Unlike that schematically illustrated in FIG. 1, 16 or 18 and as discussed above, the left-handed door pull arrangement schematically illustrated in FIGS. 20 and 21 has the pivot axis 12 for the door 10 and the powered driver 32 both arranged toward an exterior 10*b* of the door 10. That is, and despite numerous structural differences between the door arrangements shown in FIG. 1 or FIG. 16 or FIG. 18 with the door arrangement schematically represented in FIGS. 20 and 21, including the different arrangement of the door pivot axis 12 along with the position of the powered driver 32, a different arrangement of the same components comprising the modular linkage system design set forth by the present invention disclosure advantageously allows the same crank arm component 42, the same elongated track component 60, the same multilink component 70, and the same rigid block component 90, as discussed in detail above, arranged as schematically illustrated in FIG. 20 as compared to FIGS. 18 and 19 to interconnect the driver 32 with and positively move the left-handed pull door from the closed position illustrated in FIG. 20 to the open position illustrated in FIG. 21.

In the arrangement illustrated by way of example in FIG. 20, one end of the same crank arm component 42, illustrated and discussed above, is suitably oriented and secured to the output shaft 34 of driver 32. Because the driver 32 is mounted to an exterior side of the door 10 in FIGS. 20 and 21 rather than to an interior side of the door 19 (as schematically illustrated in FIGS. 1 and 16), the disposition or orientation of the generally L-shaped crank arm component 42 is easily and readily adjusted to accommodate the disposition of the driver 32 relative to the door 10. An opposite or free-end of the same crank arm component 42, illustrated and discussed above, is connected to one end of the same adjustable multilink component 70 illustrated and discussed above. After adjusting the operative length OL (FIG. 9) of the multipiece linkage 70, the same pin assembly 100, illustrated and discussed above, serves to articulately interconnect an opposite end of the adjustable multilink component 70 with the block component 90. As will be appreciated from an understanding of this invention disclosure, the block component 90 used in operable combination with the modular linkage system 40 is the same component illustrated and discussed above with the linkage arrangement illustrated in FIGS. 1, 16 and 18. As schematically illustrated in FIG. 20, the block component 90 is slidably arranged within the confines of the elongated channel 65 defined by the same elongated track component 60, illustrated and discussed above, regarding the linkage system shown in FIGS. 1, 16 and 18 and the elongated track component 60 is secured or connected to the exterior side 10*b* of door 10.

To open the left-handed pull door 10 illustrated in FIG. 20, the output shaft 34 of the powered driver 32 is rotated in an appropriate direction about axis 37 whereby angularly driving the crank arm component 42 of the modular linkage system 40 from the position illustrated in FIG. 20 to the position schematically illustrated in FIG. 21. As the crank arm component 42 of the modular linkage system 40 moves toward the position illustrated in FIG. 21, the multilink component 70 pulls the block component 90 through the channel 65 defined by the elongated track component 60 while imparting an opening force or action on the door 10.

Figure 22:
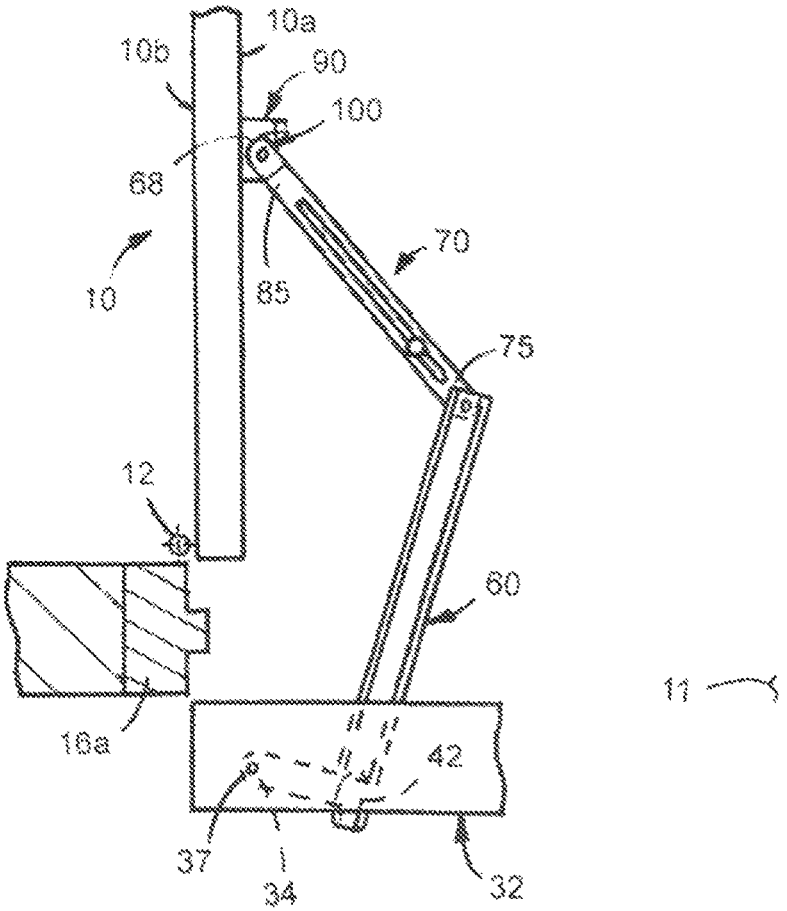
FIG. 22 is a view, partly in section, of an alternative configuration of the same modular linkage system comprised of the same components illustrated in FIGS. 1, 16 and 20 but connected to a closed left handed-push door wherein a pivot axis for the door is arranged to an exterior side of the door while the connected driver is arranged toward an interior side of the door.
Figure 23:
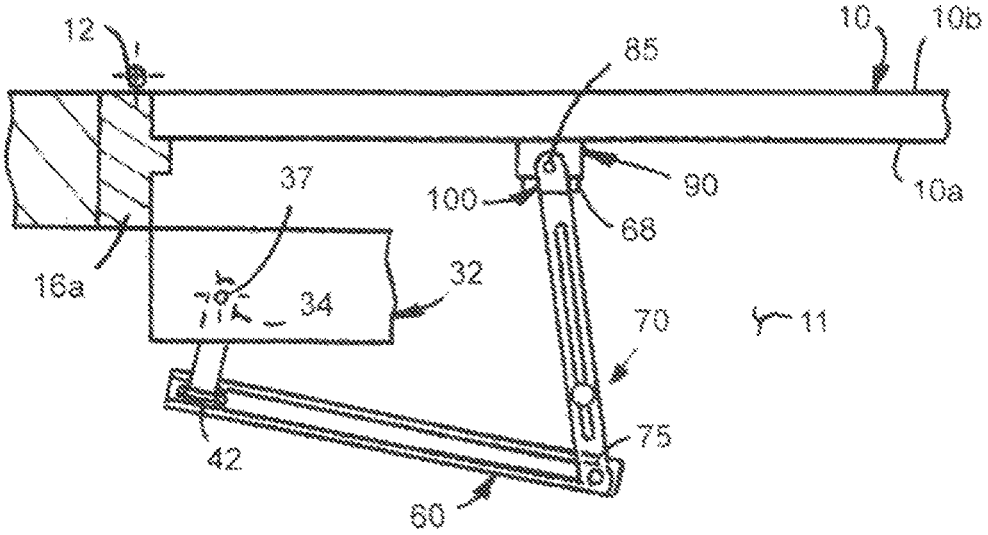
FIG. 23 is a view, partly in section, similar to FIG. 22 but showing the relative arrangement of the modular linkage system components when the left-handed push door shown in FIG. 22 is in an open position.

Yet another alternative configuration of the modular linkage assembly 40, and the modularity aspect which is uniquely inherent with the present invention disclosure is set forth by way of example in FIGS. 22 and 23. Unlike those door arrangements schematically illustrated in FIG. 1, 16, 18 or 20 and discussed above, the door arrangement schematically illustrated in FIGS. 20 and 21 involves a left-handed push door 10 whose pivot axis 12 along with the powered driver 32 for moving the door from a closed to an open position are both arranged toward an interior 10*a* of the door 10. Despite numerous structural differences between the door arrangements schematically shown in FIG. 1, 16, 18 or 22 with the door arrangement schematically represented in FIGS. 22 and 23 including the different arrangement of the door pivot axis 12 along with the position of the powered driver 32, a different arrangement of the same components discussed above comprising the modular linkage system design set forth by the present invention disclosure advantageously allows the same crank arm component 42, the same elongated track component 60, the same multilink component 70, and the same rigid block component 90, as discussed in detail above, arranged as schematically illustrated in FIG. 22 (as compared to FIG. 1, 16, 18 or 20) to interconnect the driver 32 with and positively move the left-handed push door from the closed position schematically illustrated in FIG. 22 toward the open position schematically illustrated in FIG. 23.

In the left-handed door arrangement illustrated by way of example in FIG. 22, one end of the same crank arm component 42, illustrated and discussed above, is suitably oriented and secured to the output shaft 34 of driver 32. As discussed above, and because the driver 32 is mounted to an interior side of the door 10 in FIGS. 22 and 23 rather than to an exterior side of the door 10 (as schematically illustrated in FIGS. 18 and 20), the disposition or orientation of the generally L-shaped crank arm component 42 can be easily and readily adjusted to accommodate the disposition of the driver 32 relative to the door 10. An opposite or free-end of the same crank arm component 42, illustrated and discussed above, is connected toward one end of the elongated track component 60. In the arrangement schematically illustrated in FIG. 20, and from its connection with the crank arm component 42, the elongated track component 60 extends toward an opposite end whereat the track component 60 is articulately connected or joined to one end of the multilink component 70, illustrated and discussed in detail above. After adjusting the operative length OL (FIG. 9) of the multipiece linkage 70, the same pin assembly 100, illustrated and discussed above, serves to articulately interconnect an opposite end of the adjustable multilink component 70 with the block component 90. As will be appreciated from an understanding of this invention disclosure, the block component 90 used in operable combination with the modular linkage system 40 is the same component illustrated and discussed above with the linkage arrangement illustrated in FIGS. 1, 16, 18 and 20. As schematically illustrated in FIG. 22, and in this alternative arrangement of the linkage system, and unlike the alternative arrangements discussed above, the block component 90 is secured or suitably connected to the interior side 10*b* of door 10.

As will be apparent from FIGS. 22 and 23, the modular linkage system 40 of this invention disclosure readily and advantageously promotes using the same components as discussed above in various configurations or arrangements of the linkage system 40 for positively pushing the left-handed push door 10 from the closed position illustrated in FIG. 22 to the open position illustrated in FIG. 23. That is, and despite the several structural differences between those door arrangement schematically shown in FIGS. 1, 16, 18 and 20 with the door arrangement in FIGS. 22 and 23, including the different arrangement of the pivot axis 12 about which door 10 swings along with the interior mounting the powered driver 32, the modular linkage system design set forth by the present invention disclosure offers several advantages and benefits. Notably, the unique and modular linkage system design set forth by the present invention disclosure allows use of the same crank arm component 42, the same elongated track component 60, the same multilink component 70, and the same block component 90, as discussed in detail above, in a different arrangement to interconnect the left-handed push door 10 with the powered driver 32.

To open the left-handed push door 10 illustrated in FIG. 23, the output shaft 34 of the powered driver 32 is rotated in an appropriate direction about axis 37 whereby angularly driving the crank arm component 42 of the modular linkage system 40 from the position illustrated in FIG. 22 to the position schematically illustrated in FIG. 23. As the crank arm component 42 of the modular linkage system 40 positively moves toward the position illustrated in FIG. 23, the elongated track component 60 pushes and drives adjustable multilink component 70 from the position illustrated in FIG. 22 to the position illustrated in FIG. 23. As such, the adjusted multilink component 70 pushes against the block component 90 suitably fastened to the interior of door 10 whereby causing the door 10 to pivot about axis 12 to an open position (FIG. 23).

Figure 24:
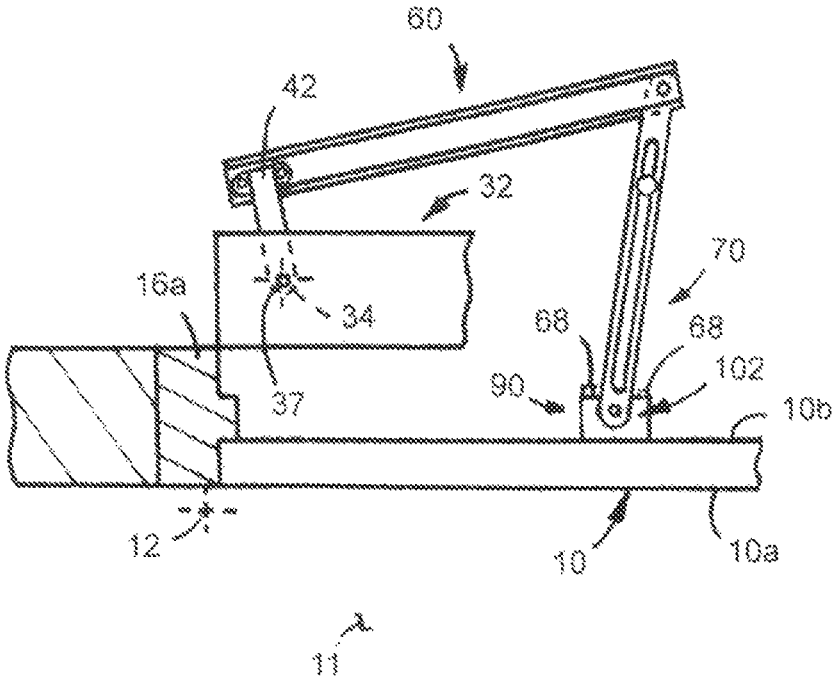
FIG. 24 is a view, partly in section, of yet another alternative configuration of the same modular linkage system comprised of the same components illustrated in FIGS. 1, 16 and 20 but connected to a closed left handed-push door wherein a pivot axis for the door is arranged to an interior side of the door while the connected driver is arranged toward an exterior side of the door.
Figure 25:
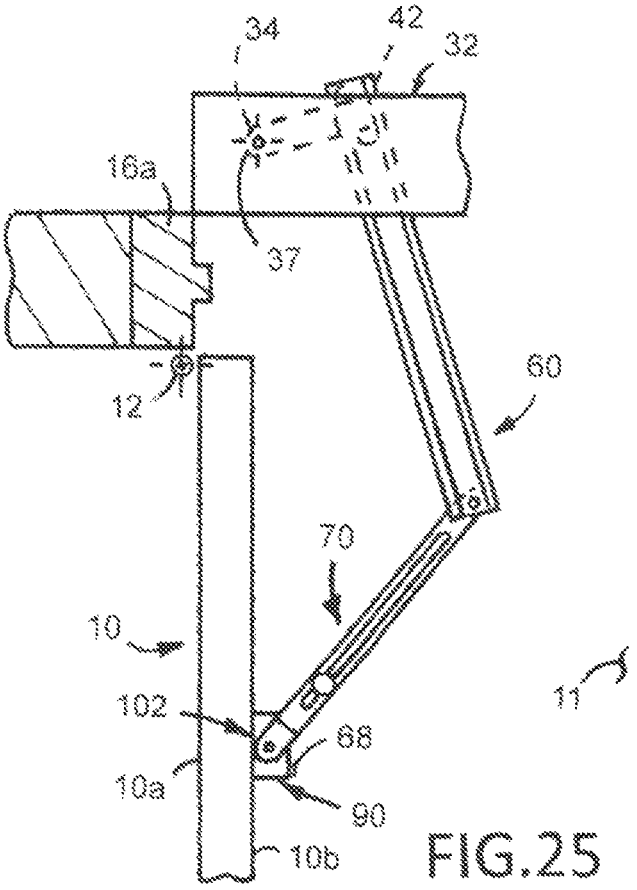
FIG. 25 is a view, partly in section, similar to FIG. 24 but showing the relative arrangement of the modular linkage system components when the left-handed push door shown in FIG. 24 is in an open position.

Still another example of the modularity aspect which is uniquely inherent with the present invention disclosure is set forth in FIGS. 24 and 25. In FIGS. 24 and 25, there is schematically shown a left-handed push door arrangement where the pivot axis 12 for the door 10 is disposed toward an interior of the door 10 and the powered driver 32 is arranged toward an exterior 10*b* of the door 10. FIGS. 24 and 25 furthermore schematically illustrate how this invention disclosure allows use of the same components in the modular linkage system 40, as discussed above, for positively moving the left-handed push door from the closed position illustrated in FIG. 24 to the open position illustrated in FIG. 25. That is, and again despite the several structural differences between the door arrangement shown in FIGS. 1, 16, 18, 20 and 22 with the door arrangement schematically illustrated in FIGS. 24 and 25, including the different disposition of the door axis 12 along with the powered driver 32, the universal or modular linkage system design set forth by the present invention disclosure beneficially allows use of the same crank arm component 42, the same elongated track component 60, the same multilink component 70, and the same rigid block component 90, as discussed in detail above, to interconnect the left-handed push door 10 to the powered driver 32 arranged toward an exterior of the door 10.

As will be apparent from FIGS. 24 and 25, the modular linkage system 40 of this invention disclosure readily and advantageously allows use of the same components, as discussed above, in various configurations or arrangements of the linkage system 40 for positively pushing the left-handed push door 10 from the closed position illustrated in FIG. 22 toward the open position illustrated in FIG. 23. That is, and despite the several structural differences between those door arrangement schematically shown in FIGS. 1, 16, 18, 20 and 22 with the door arrangement in FIGS. 24 and 25, including the different arrangement of the pivot axis 12 about which door 10 swings along with the exterior mounting of the powered driver 32, the modular linkage system design set forth by the present invention disclosure offers several advantages and benefits. The unique and modular linkage system design set forth by the present invention disclosure allows use of the same crank arm component 42, the same elongated track component 60, the same multilink component 70, and the same block component 90, as discussed in detail above, in a different heretofore known arrangement relative to each other to allow the interconnection between the left-handed push door 10 and the powered driver 32.

As schematically represented in FIGS. 24 and 25, the modular linkage system 40 of this invention disclosure coupled with the unique design of the component parts comprising same readily and advantageously promotes interchanging and using the same components as discussed above in various configurations or arrangements of the linkage system 40 for positively pushing the left-handed push door 10 from the closed position schematically illustrated in FIG. 24 toward the open position schematically illustrated in FIG. 25. That is, and notwithstanding the numerous structural differences between the door arrangement schematically shown in FIGS. 1, 16, 18, 20 and 22 with the door arrangement schematically represented in FIGS. 24 and 25, including the different arrangement of the pivot axis 12 about which door 10 swings along with the exterior mounting of the powered driver 32, the modular linkage system design set forth by the present invention disclosure offers several advantages and benefits. Notably, the unique and modular linkage system design set forth by the present invention disclosure allows use of the same crank arm component 42, the same elongated track component 60, the same multilink component 70, and the same block component 90, as discussed in detail above, in a different arrangement to interconnect the left-handed push door 10 with the powered driver 32.

The left-handed push door 10 schematically illustrated in FIG. 24 can be readily opened toward the open position schematically illustrated in FIG. 25 to quickly and readily provide access to the interior of room or space 11. As the properly oriented crank arm component 42 of the modular linkage system 40 moves toward the position illustrated in FIG. 25, the elongated track component 60 connected to crank arm component 42 pushes and drives adjustable multilink component 70 from the position illustrated in FIG. 24 to the position illustrated in FIG. 25. As such, the multilink component 70 pushes against the block component 90 suitably fastened to the door 10 whereby causing the door 10 to pivot about axis 12 toward an open position (FIG. 25).

Figure 26:
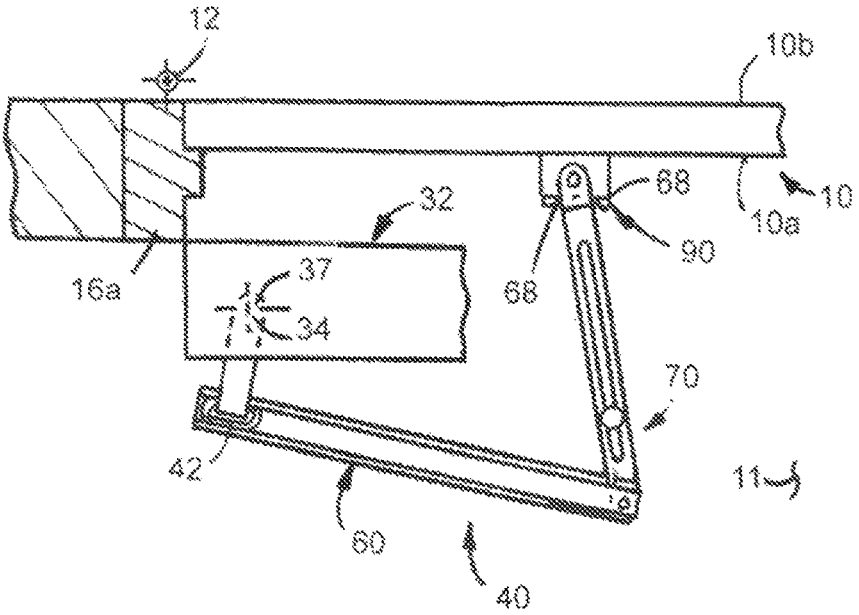
FIG. 26 is a view, partly in section, of still another alternative configuration of the same modular linkage system comprised of the same components illustrated in FIGS. 1, 16, 20 and 24 but connected to a closed left handed-push door wherein a pivot axis for the door is arranged to an exterior side of the door while the connected driver is arranged toward an interior side of the door.
Figure 27:
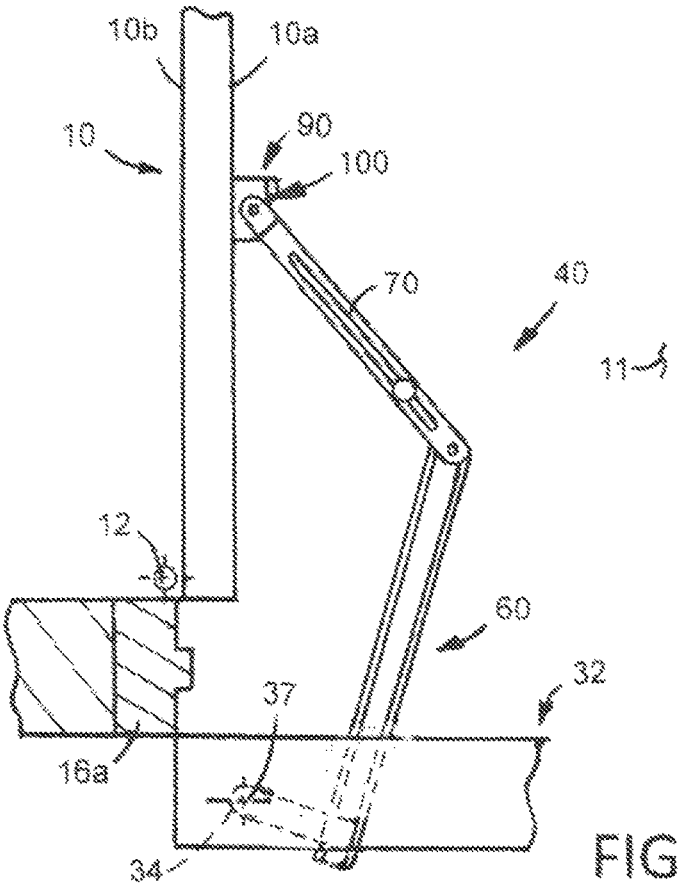
FIG. 27 is a view, partly in section, similar to FIG. 26 but showing the relative arrangement of the modular linkage system components when the left-handed push door shown in FIG. 26 is in an open position.

Yet another example of the modularity aspect which is uniquely inherent with the present invention disclosure is set forth in FIGS. 26 and 27. In FIGS. 26 and 27, there is schematically shown a left-handed push door arrangement where the pivot 12 for the door 10 is arranged toward an exterior of door 10 while the powered driver 32 is mounted or otherwise secured toward an interior 10*a* of the door 10. As with the other multiple configurations of the modular linkage system 40 discussed above, FIGS. 26 and 27 schematically illustrate advantageously using the same components of the modular linkage system 40, as discussed above, for positively moving the left-handed push door from the closed position illustrated in FIG. 26 toward the open position illustrated in FIG. 27. That is, and notwithstanding the numerous structural differences which are notable when comparing the door arrangement schematically shown in FIGS. 1, 16, 18, 20 and 24 with the door arrangement schematically represented in FIGS. 26 and 27 including the different arrangement of the axis 12 along with the powered driver 32 and the overall linkage connecting the door 10 to the driver 32, the modular linkage system design set forth by the present invention disclosure advantageously allows using the same crank arm component 42, the same elongated track component 60, the same adjustable multilink component 70, and the same rigid block component 90, as discussed in detail above, to interconnect the left-handed push door 10 to the powered driver 32 arranged toward an interior of the door 10.

Notably, however, in comparing the configuration of the modular linkage system 40 shown in FIGS. 18, 20 and 24 with the embodiment illustrated in FIGS. 26 and 27, and because the driver 32 in FIGS. 26 and 27 is arranged an interior rather than exterior side of the door 10 as illustrated in FIGS. 18, 20 and 24, the angular disposition or orientation of the generally L-shaped crank arm component 42 has been simply reversed in the different embodiments to easily and readily accommodate the change in the disposition of the driver 32 relative to the door 10. To open the left-handed push door 10 illustrated in FIG. 26, the output shaft 34 of the powered driver 32 is rotated in an appropriate direction about axis 37 whereby angularly driving the crank arm component 42 of the modular linkage system 40 from the position illustrated in FIG. 26 to the position schematically illustrated in FIG. 27. As the properly oriented crank arm component 42 of the modular linkage system 40 moves toward the position illustrated in FIG. 27, the elongated track component 60 connected to crank arm component 42 pushes and drives adjustable multilink component 70 from the position illustrated in FIG. 26 toward the position illustrated in FIG. 27. As such, the multilink component 70 pushes against the block component 90 suitably fastened to the interior side 10*a* of door 10 whereby causing the door 10 to pivot about axis 12 toward an open position (FIG. 27).

As schematically depicted in the various embodiments, the modular linkage system 40 of the present invention disclosure and the unique structure of the multiple and various components thereof to be interchanged relative to each other whereby allowing them to be advantageously arranged in different relationships relative to each other to accomplish results which were heretofore unobtainable. That is, the multiple components comprising system are each configured whereby allowing them to be simply adjusted and reconfigured relative to each other such that they can be used together in multiple applications thus eliminating the heretofore required duplicity of parts for accomplishing the same result. Accordingly, repair people will be able to simply and advantageously use the modularity or universal nature of the present invention to reduce time on the doors requiring repair (whether such doors are left or right handed and whether they are push or pull) and, thus, advantageously resulting in less downtime for the owner of the facility whose door needs repair. Moreover, because the various components embodied into the modular linkage system of the present invention disclosure are usable in a multiple array of linkage systems having different configurations, there should be less inventory to handle and stock for repairs. These and other advantages will become more readily apparent from a better and truer appreciation of the present invention disclosure.

From the foregoing, it will be observed that numerous modifications and variations can be made and effected without departing or detracting from the true spirit and novel concept of this invention disclosure. Moreover, it will be appreciated, the present disclosure is intended to set forth exemplifications which are not intended to limit the disclosure to the specific embodiments illustrated. Rather, this disclosure is intended to cover by the appended claims all such modifications and variations as fall within the spirit and scope of the claims.

What is claimed is:

1. A modular door operating linkage system connectable to and extendable from a door, moveable through varying degree of angular movements and in opposite directions between closed and open positions about a generally vertical axis, and a powered driver having an output drive shaft, with said door having interior and exterior sides, and with said modular door operating linkage system comprising:

a rigid generally L-shaped crank arm component having a first end and a free-ended second end, with the first end of said crank arm being connected to a driver which positively drives said crank arm component in opposite arcuate directions;

a rigid elongated track component having opposed ends and defines a generally C-shaped linear open-sided channel extending the length of said track component;

a rigid link component having opposed ends and multiple pieces between said opposed ends, with an overall length of said link component being adjustable between the opposed ends thereof, with a suitable fastener being arranged in operable combination with the multiple pieces of said link component to adjustably fix the overall length of said link component as desired or required;

a rigid block component sized to snugly fit and slidably move within the generally C-shaped channel defined by said rigid elongated track component in one alternative configuration of said modular door operating linkage system, and with said block component being configured to be fastened to said door in another alternative configuration of said modular linkage system; and with the rigid elongated track component, the rigid link component, and the rigid block component of said linkage system being configured, arranged and alternatively connected to each other and to said door in different arrangements and scenarios to easily and readily accommodate different environments wherein the door is utilized.

2. The modular door operating linkage system according to claim 1, wherein said elongated track component has a bottom wall, two laterally spaced side walls extending upward from said bottom wall, and with each side wall of said track component having two top wall sections extending generally coplanar relative to each other and toward a longitudinal center of said track component so as to provide the generally C-shaped linear open-sided channel defined by said track component with a predetermined width and a predetermined height.

3. The modular door operating linkage system according to claim 2, wherein each side wall of said elongated track component defines openings which laterally align relative to each other toward opposite ends thereof for permitting elongated fasteners to extend therethrough so as to secure said elongated track component to either side of said door in an alternative configuration of said linkage system.

4. The modular door operating linkage system according to claim 3, wherein said rigid block component is configured with upper and lower surfaces along with front and rear sides and defines a bore opening to the upper and lower surfaces thereof whereby permitting said rigid block component, in one configuration of said linkage system, to be arranged for sliding movement within the elongated C-shaped channel of said rigid elongated track component and articulately connected to the rigid and elongated link component of the modular door linkage system, and with said rigid block component, further defining spaced bores opening to front and rear sides thereof whereby permitting said rigid block component, in an alternative configuration of said linkage system, to be connected by elongated fasteners to either side of said door.

5. The modular door operating linkage system according to claim 4, wherein the elongated fasteners used to secure said rigid track component to either side of said door, in one configuration of said linkage system, can be used to connect said rigid block component to either side of said door, in an alternative configuration of said linkage system.

6. The modular door operating linkage system according to claim 2, wherein the bottom wall of said elongated track component defines one or more openings toward opposite ends thereof whereby allowing the opposed ends of said elongated track component to alternatively be connected to said rigid crank arm component, or to said rigid elongated link component of the modular door operating linkage system in alternative configurations of said linkage system.

7. The modular door operating linkage system according to claim 2, wherein said rigid block component of said linkage system has a predetermined width and a predetermined height which are substantially equal to the predetermined width and the predetermined height defined by the generally C-shaped channel of said elongated track component.

8. The modular door operating linkage system according to claim 1, with said rigid link component of said modular linkage system defining one or more openings toward opposed ends thereof whereby allowing said opposed ends of said rigid link component to be articulately connected to said crank arm component, the rigid block component, or the elongated track component in alternative configurations of the modular door operating linkage system.

9. The modular door operating linkage system according to claim 1, wherein said rigid block component further includes a mechanism for biasing said rigid block component in one direction within the generally C-shaped channel defined by said elongated track component.

10. The modular door operating linkage system according to claim 1, wherein an adjustable coupling is disposed between the first end of said crank arm component and the output drive shaft of said powered driver.

11. The modular door operating linkage system according to claim 1, wherein said rigid crank arm component is configured such that said crank arm component can be oriented in different dispositions relative to the rigid elongated track component, or the rigid link component connected thereto in alternative configurations of said modular linkage system so as to allow said modular linkage system to be used in operable combination with the door which moves through varying degrees of angular movement and in opposite directions between closed and open positions.

12. A method for connecting either a left-hand or right-hand door, movable between closed and open positions about a generally vertical axis, to a powered driver having a driven output shaft, with said door having interior and exterior sides, said method comprising the steps of:

providing a modular linkage system between either the left-handed or right-handed door and the driven output shaft of said powered driver, with said modular linkage system being adjustable to assume alternative configurations to push or pull either the left-handed or right-handed door between said positions from either an interior side or an exterior side of said door, with said linkage system including a rigid generally L-shaped crank arm component connected to the driven output shaft of said powered driver, an elongated rigid track component defining an elongated generally C-shaped channel extending the length thereof and which, in one alternative configuration of said modular linkage assembly, is configured to facilitate said elongated track component being connected to either side of said door, and an elongated rigid multipiece link component, which, in alternative configurations of said modular linkage system, is configured for connection to said elongated track component and said crack arm component, or to said elongated track component and a rigid block component having a predetermined height and a predetermined width, with said rigid block component being configured, in one alternative configuration of said modular linkage system, to fit within the elongated channel defined by said rigid elongated track component for sliding movements, or, in another alternative configuration of said modular linkage system, be secured to either side of the door and to one end of said elongated track component;

orientating said generally L-shaped crank arm component and the connection of said crank arm component to the driven output shaft of the powered driver as a function of whether said powered driver is mounted to the interior side of or to the exterior side of the door; and selecting which alternative configuration of said modular linkage system is best suited to accommodate the direction said door opens from the closed position and whether the powered driver for said modular linkage system is mounted to either the interior side or exterior side of said door.

13. The method for connecting a door to a powered driver according to claim 12 wherein the step of selecting which configuration of said modular linkage system is best suited to accommodate operation of said door involves the step of:

selecting the overall length of said rigid multipiece link component along with selecting whether the multipiece link component is to be articulately connected to: the crank arm component, the block component, and whether said block component is slidably arranged within the elongated track component or connected to either side of said door, and which of said components are to be operably connected to each other and in what order whereby allowing said elongated track component, said multipiece link component and said rigid block component of said modular linkage system to be used in alternative configurations relative to each other.

14. The method for connecting a door to a powered driver according to claim 12 wherein elongated fasteners, securing said elongated track component to either side of said door, in one configuration of said modular linkage system, generally correspond in configuration to the elongated fasteners securing said block component to either side of said door in an alternative configuration of said modular linkage system.

15. The method for connecting a door to a powered driver according to claim 12 including the further step of: biasing the rigid block component of said modular linkage system in one direction when said linkage system is configured such that said rigid block component is captured for sliding movements within the generally C-shaped channel of said elongated track component.

16. The method for connecting a door to a powered driver according to claim 12, further including the step of: using an adjustable coupling disposed between the first end of said crank arm component and the driven output shaft of said powered driver for angularly orienting said crank arm component in different angular positions relative to said output drive shaft and about an axis of said output drive shaft.

* * * * *